US006275125B1

(12) United States Patent
Takei et al.

(10) Patent No.: US 6,275,125 B1
(45) **Date of Patent: *Aug. 14, 2001**

(54) WAVE FILTER HAVING TWO OR MORE COAXIAL DIELECTRIC RESONATORS IN JUXTAPOSITION

(75) Inventors: Kenji Takei, Misato-machi; Hisahiro Yasuda, Gunma-machi; Kazuhisa Sato, Takasaki; Makoto Inoue, Haruna-machi; Takeshi Kosaka, Takasaki; Kenji Yoshimori, Misato-machi; Masao Igarashi, Takasaki, all of (JP)

(73) Assignee: Taiyo Yuden Co., Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/504,351

(22) Filed: Feb. 15, 2000

Related U.S. Application Data

(63) Continuation of application No. 09/038,870, filed on Mar. 11, 1998, now Pat. No. 6,081,174.

(30) Foreign Application Priority Data

| | | |
|---|---|---|
| Mar. 14, 1997 | (JP) | 9-82277 |
| Mar. 28, 1997 | (JP) | 9-94760 |
| Apr. 4, 1997 | (JP) | 9-102462 |
| Apr. 5, 1997 | (JP) | 9-102784 |

(51) Int. Cl.[7] ..... H01P 1/202
(52) U.S. Cl. ..... 333/206; 333/222
(58) Field of Search ..... 333/202, 206, 333/207, 222, 223

(56) References Cited

U.S. PATENT DOCUMENTS

| | | | | |
|---|---|---|---|---|
| 4,855,693 | | 8/1989 | Matsukura et al. | 333/206 X |
| 4,879,533 | | 11/1989 | de Muro et al. | 333/206 |
| 5,162,760 | * | 11/1992 | Phillips et al. | 333/206 |
| 5,499,004 | | 3/1996 | Noguchi et al. | 333/206 X |
| 5,578,975 | | 11/1996 | Kazama et al. | 333/202 |
| 6,081,174 | * | 6/2000 | Takei et al. | 333/206 |

FOREIGN PATENT DOCUMENTS

| | | | | |
|---|---|---|---|---|
| 576273 | | 12/1993 | (EP) . | |
| 0 635 897 A1 | * | 1/1995 | (EP) | 333/206 |
| 2 276 041 A | | 9/1994 | (GB) . | |
| 6-303006 | * | 10/1994 | (JP) | 333/206 |
| 7-30305 | | 1/1995 | (JP) . | |
| 7-176911 | | 7/1995 | (JP) . | |
| 8-195602 | * | 7/1996 | (JP) | 333/206 |

* cited by examiner

*Primary Examiner*—Benny Lee
*Assistant Examiner*—Barbara Summons
(74) *Attorney, Agent, or Firm*—Woodcock Washburn Kurtz Mackiewicz & Norris LLP

(57) ABSTRACT

A radio frequency filter having at least two dielectric resonators in juxtaposition, each resonator including a tubular dielectric body. Formed on the dielectric body of each resonator are an inner and an outer conductors and various other conductors including a terminal conductor for connection of the filter to external circuitry. In order to assure positive isolation of the terminal conductors of both resonators from each other, the outer conductors are provided with extensions which intervene between the terminal conductors for preventing then from being capacitively coupled together.

6 Claims, 22 Drawing Sheets

WAVE FILTER HAVING TWO OR MORE COAXIAL DIELECTRIC RESONATORS IN JUXTAPOSITION

This Application is a continuation of application Ser. No. 09/038,870, filed Mar. 11, 1998, now U.S. Pat. No. 6,081, 174.

BACKGROUND OF THE INVENTION

The present invention relates generally to wave filters, and deals more specifically with radio frequency filters of the kind comprising two or more coaxial dielectric resonators in juxtaposition. The radio frequency filters according to the invention find typical applications in mobile or portable telephone sets, although no unnecessary limitations thereto are intended.

Bandpass or bandstop radio frequency filters have been known which typically take the form of a pair of juxtaposed coaxial dielectric resonators operating in transverse electromagnetic (TEM) mode, as disclosed for example in U.S. Pat No. 5,578,975 to Kazama et al. Methods have also been known of capacitively coupling together the dielectric resonators One such known method, according to Japanese Unexamined Pat. PUb. No. 7-176911, teaches to provide layers of electrically conductive material on the opposed surfaces of the resonators, thereby obtaining capacitances between the conductive layers and the inner conductors of the resonators, and to solder or otherwise join the conductive layers. These conductive layers are referred to as resonator coupling conductors.

The dielectric resonators have been further provided with additional conductor layers on their outer surfaces for use as terminals in connecting the filter to external circuits. These terminals should of course be electrically isolated from each other as much as possible. Difficulties have been encountered, however, in realizing a desired degree of isolation between the terminals because they have been capacitively coupled together in devices composed of juxtapositions of two or more dielectric resonators.

Additional problems left unsolved with dielectric resonator wave filters arise from the present-day demand for smaller and smaller devices. The outer conductor of each resonator is provided with extensions to one end of the dielectric body according to one known downsizing method, and, according to another such method, the inner conductor is joined directly to a conductive layer, or inner conductor extension, formed on one end of the dielectric body.

Such known downsizing methods are alike in aiming at lower resonance frequencies with each dielectric body maintained at the same length as before. This objective, known as the wavelength shortening effect, is obtained as the capacitance between the extensions of the outer conductor and the inner conductor, or between the extension of the inner conductor and the outer conductor, of each resonator is connected in parallel with the resonance circuit of each resonator proper, resulting in a decrease in resonance frequency. For example, the resonance frequency of a device having a pair of dielectric resonators may decrease from 1900 megahertz, in the case where no such downsizing measures are taken, to as low as 1000 megahertz when the noted capacitance additionally connected in parallel with the resonance circuit of each resonator is 20 picofarads.

Let us now consider a wave filter comprised of juxtaposed dielectric resonators having the inner conductor extensions, the terminal conductors, and the resonator coupling conductor Capacitances between resonator coupling conductors and inner conductors and capacitances between terminal conductors and inner conductors change with the size of the inner conductor extensions. The aforesaid wavelength shortening effect is therefore not adjustable by the inner conductor extensions without affecting the capacitances in question.

The terminal conductors and the resonator coupling conductors have presented a further problem. These conductors have been required to be of not less than a certain size for providing the desired capacitances, running counter to the size reduction of the filters incorporating them.

A yet further problem with dielectric filters in general has been the spurious resonance at thrice the fundamental frequency or thereabouts. The spurious resonance has resulted in insufficient attenuation of that higher harmonic.

SUMMARY OF THE INVENTION

In view of the foregoing state of the art it Is among the objects of the present invention to improve lation between the terminal conductors in wave filters having two or more dielectric resonators in juxtaposition.

Another object of the invention is to make readily adjustable the wavelength shortening effect of wave filters of the kind defined, with little or no influence on capacitances between resonator coupling conductors and inner conductors or on capacitances between terminal conductors and inner conductors.

Yet another object of the invention is to reduce the sizes of the terminal conductors and the resonator coupling conductors in wave filters of the kind defined.

A further object of the invention is to overcome the spurious resonance that has heretofore occurred at about thrice the fundamental frequency in wave filters of the kind defined, and hence to make possible the attenuation of that harmonic frequency.

Briefly, the invention concerns a dielectric wave filter having at least two dielectric resonators in juxtaposition. Each dielectric resonator comprises a dielectric body having a plurality of side surfaces between a pair of opposite end surfaces, and a resonance hole extending between the pair of end surfaces. An inner conductor covers an inner surface of the dielectric body whereas an outer conductor covers those parts of the side surfaces of the dielectric body which are contiguous to one of the end surfaces of the dielectric body. The outer conductors on both dielectric bodies are joined to each other both mechanically and electrically. A shorting conductor covers said one end surface of the dielectric body and so electrically interconnects the inner and the outer conductors. Also formed on each dielectric body are a resonator coupling conductor covering part of at least that side surface of each dielectric body which confronts the other dielectric body, and a terminal conductor covering part of the side surfaces of each dielectric body and disposed adjacent the other of the end surfaces thereof. The resonator coupling conductors on both dielectric bodies are joined to each other both mechanically and electrically. The terminal conductors on both dielectric bodies are disposed at least on those side surfaces of the dielectric bodies which face away from each other. The invention particularly features an outer conductor extension extending from the outer conductor on each dielectric body toward said other end surface thereof, the outer conductor extensions on both dielectric bodies being disposed at least on those side surfaces of the dielectric bodies which confront each other, thereby intervening between the terminal conductors on both dielectric bodies.

Thus the terminal conductors of the two dielectric resonators are better isolated from each other than heretofore by the outer conductor extensions intervening therebetween. Experiment has proved that little or no signal leakage occurs from the input to the output terminal conductors in filters constructed according to this invention.

The outer conductor extensions on the dielectric bodies serve the additional purpose of providing the wavelength shortening effect by virtue of capacitances between them and the inner conductor The wavelength shortening effect makes it possible to provide smaller size filters.

According to a further feature of the present invention, the inner conductor of each resonator is also provided with an extension. Disposed on said other end surface of each dielectric body, the inner conductor extensions function to make the wavelength shortening effect even more pronounced.

According to a still further feature of this invention, the outer conductor extensions can be so patterned as to provide greater inductances for attenuating the third harmonic of the fundamental frequency.

The above and other objects, features and advantages of this invention and the manner of realizing them will become more apparent, and the invention itself will best be understood, from a study of the following description of specific embodiments with reference had to the attached drawings.

DESCRIPTION OF THE PREFERRED EMBODIMENTS

The present invention will now be described more specifically in terms of its first preferable embodiment illustrated in FIGS. 1–13. The representative filter is broadly comprised of two TEM mode, coaxial dielectric resonators 1 and 2 seen in FIGS. 1–4. The resonators 1 and 2 are alike in comprising dielectric bodies 3*a* and 3*a*, inner conductors 4*a* and 4*b*, outer conductors 5*a* and 5*b*, shorting conductors 6*a* and 6*b*, resonator coupling conductors 7*a* and 7*b*, terminal conductors 8*a* and 8*b* inner conductor extensions 9*a* and 9*b*, first outer conductor extensions 17*a* and 17*b*, and second outer conductor extensions 18*a* and 18*b*.

The dielectric bodies 3*a* and 3*a* are substantially tubular in shape, preferably square in cross section each having a first end surface 10*a* or 10*b*, a second end surface 11*a* or 11*b*, a first side surface 12*a* or 12*b*, a second side surface 13*a* or 13*a*, a third side surface 14*a* or 14*b*, and a fourth side surface 15*a* or 15*b* A resonance hole 16*a* or 16*b* extends longitudinally through each dielectric body 3*a* or 3*a*, between the first 10*a* or 10*b* and second 11*a* or i 1*b* end surfaces.

The inner conductors 4*a* and 4*b* of the resonators 1 and 2 line the walls bounding the resonance holes 16*a* and 16*b* in the dielectric bodies 3*a* and 3*b*, whereas the outer conductors 5*a* and 5*b* cover the four side surfaces 12*a* and 12*b*, 13*a* and 13*b*, 14*a* and 14*b*, and 15*a* and 15*b* of the dielectric bodies The shorting conductors 6*a* and 6*b* are formed on the second end surfaces 11*a* and 11*b* of the dielectric bodies 3*a* and 3*a*, interconnecting the inner 4*a* and 4*b* and outer 5*a* and 5*b* conductors.

The resonator coupling capacitors 7*a* and 7*b*, through which the two resonators 1 and 2 are coupled together, are formed on parts of the dielectric body first 12*a* and 12*b* and second 13*a* and 13*b* side surfaces The terminal conductors 8*a* and 8*b* are formed on parts of the dielectric body third 14*a* and 14*b* and fourth 15*a* and 15*b* side surfaces The outer conductor first extensions 17*a* and 17*b* are formed on parts of the dielectric body second 13*a* and 13*a* and third 14*a* and 14*b* side surfaces The outer conductor second extensions 18*a* and 18*b* are formed on parts of the dielectric body first 12*a* and 12*b* and fourth 15*a* and 15*b* side surfaces.

Figure 1:
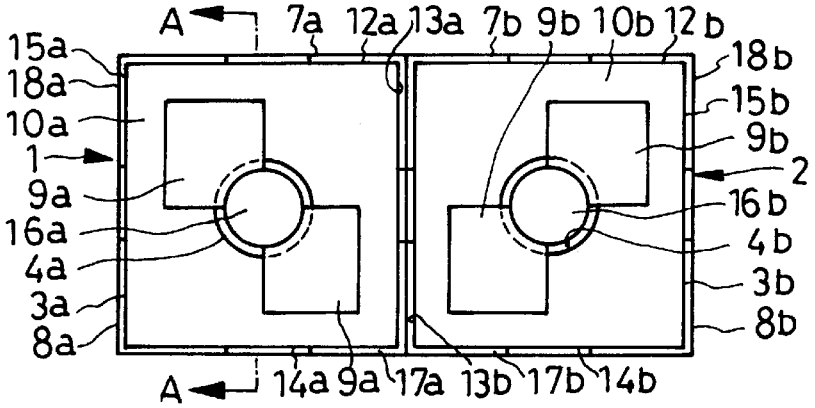
FIG. 1 is an end elevation of a first preferred form of dielectric wave filter according to the present invention.
Figure 2:
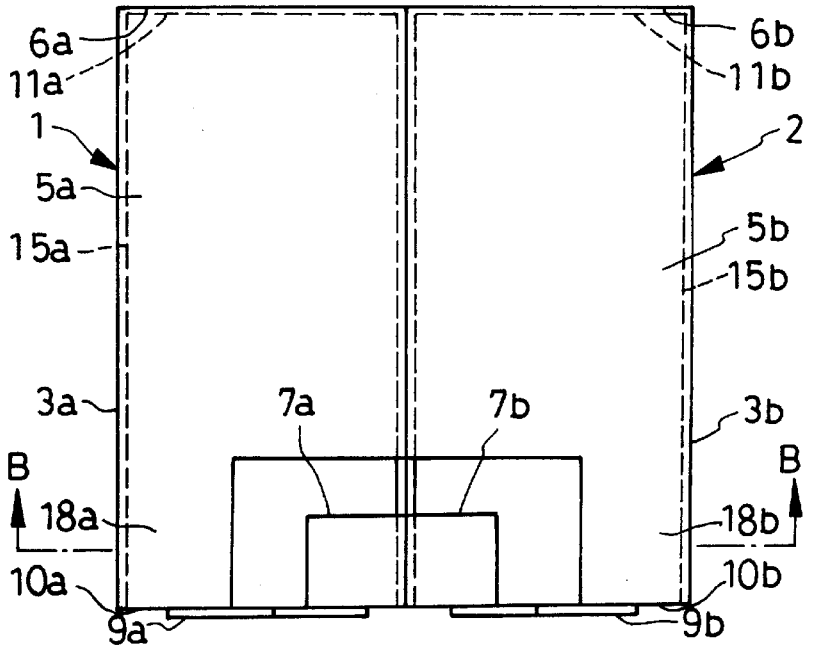
FIG. 2 is a top plan of the FIG. 1 filter.
Figure 3:
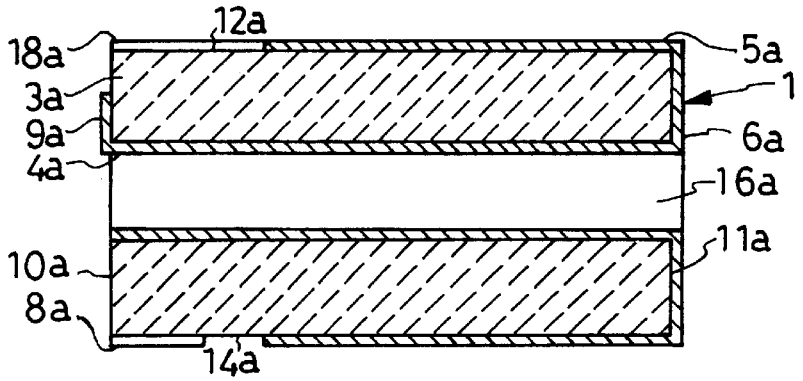
FIG. 3 is a longitudinal section through the FIG. 1 filter, taken along the line A—A in FIG. 1.

FIG. 1 best illustrates that the two resonators 1 and 2 are juxtaposed with the dielectric body second side surfaces 13*a* and 13*a* oriented toward each other. The resonators 1 and 2 are coupled together, both mechanically and electrically, by an electroconductive bonding agent such as solder joining those parts of the outer conductors 5*a* and 5*b* and resonator coupling conductors 7*a* and 7*b* which overlie the dielectric body second side surfaces 13*a* and 13*b* FIG. 4 indicates the electroconductive bonding agent by the dashed lines designated 23 and 24. The layers of the bonding agent are so thin, however, that they are not shown in FIGS. 1 and 2.

The geometry of the various conductors on the dielectric bodies 3*a* and 3*b* will now be explained in more detail. The inner conductors 4*a* and 4*b*, first of all, thoroughly cover the dielectric body surfaces defining the resonance holes 16*a* and 16*b*. The shorting conductors 6*a* and 6*b* also completely cover the dielectric body second end surfaces 11*a* and 11*b*.

The outer conductors 5*a* and 5*b* cover all but parts of all the dielectric body side surfaces 12*a*–15*a* and 12*b*–15*b*, the remaining parts, left exposed by the outer conductors 5*a* and 5*b*, being contiguous to the dielectric body first end surfaces 10*a* and 10*b*. The outer conductor first extensions 17*a* and 17*b* extend from the outer conductors 5*a* and 5*b* onto mutually adjoining subparts of the noted remaining parts of the dielectric body second 13*a* and 13*a* and third 14*a* and 14*b* side surfaces, terminating at the dielectric body first end surfaces 10*a* and 10*b*. The outer conductor second extensions 18*a* and 18*b* likewise extend from the outer conductors 5*a* and 5*b* onto mutually adjoining subparts of the noted remaining parts of the dielectric body first 12*a* and 12*b* and fourth 15*a* and 15*b* side surfaces, terminating at the dielectric body first end surfaces 10*a* and 10*b*.

The resonator coupling conductors 7*a* and 7*b* are formed on subparts of the noted remaining parts of the dielectric body first 12*a* and 12*b* and second 13*a* and 13*a* side surfaces, lying contiguous to the dielectric body first end surfaces 10*a* and 10*b* and spaced from all of the outer conductors 5*a* and 5*b* and the first 17*a* and 17*b* and second 18*a* and 18*b* extensions therefrom. It is to be noted that those parts of the resonator coupling conductors 7*a* and 7*b* which overlie the dielectric body first side surfaces 12*a* and 12*b* occupy less than half the width (horizontal dimension as viewed in FIG. 1) of these dielectric body first side surs faces Similarly, those parts of the resonator coupling conductors 7*a* and 7*b* which overlie the dielectric body second side surfaces 13*a* and 13*b* occupy less than half the width (vertical dimension in FIG. 1) of these dielectric body second side surfaces.

The terminal conductors 8*a* and 8*b* are formed on subparts of the noted remaining parts of the dielectric body third 14*a* and 14*b* and fourth 15*a* and 15*b* side surfaces, lying contiguous to the dielectric body first end surfaces 10*a* and 1*b* and spaced from all of the outer conductors 5*a* and 5*b* and the first 17*a* and 17*b* and second 18*a* and 18*b* extensions therefrom. Those parts of the terminal conductors 8* and 8*b* which overlie the dielectric body third side surfaces 14*a* and 14*b* occupy less than half the width (horizontal dimension in FIG. 1) of these dielectric body third side surfaces The remaining parts of the terminal conductors 8*a* and 8*b*, overlying the dielectric body fourth side surfaces 15*a* and 15*b*, also occupy less than half the width (vertical dimension in FIG. 1) of these dielectric body fourth side surfaces.

Thus, according to a feature of the present invention, those parts of the outer conductor first extensions 17*a* and 17*b* which overlie the dielectric body second side surfaces 13*a* and 13*b* are in register, via the dielectric bodies 3*a* and 3*a*, with those parts of the terminal conductors 8*a* and 8*b* which overlie the dielectric body fourth side surfaces 15*a* and 15*b*, So interposed between the two terminal conductors 8*a* and 8*b*, which are to function respectively as input and output terminals, the outer conductor first extensions 17*a* and 17*b* serve to prevent the terminal conductors from being capacitively coupled together, thereby electrically isolating them from each other.

Figure 4:
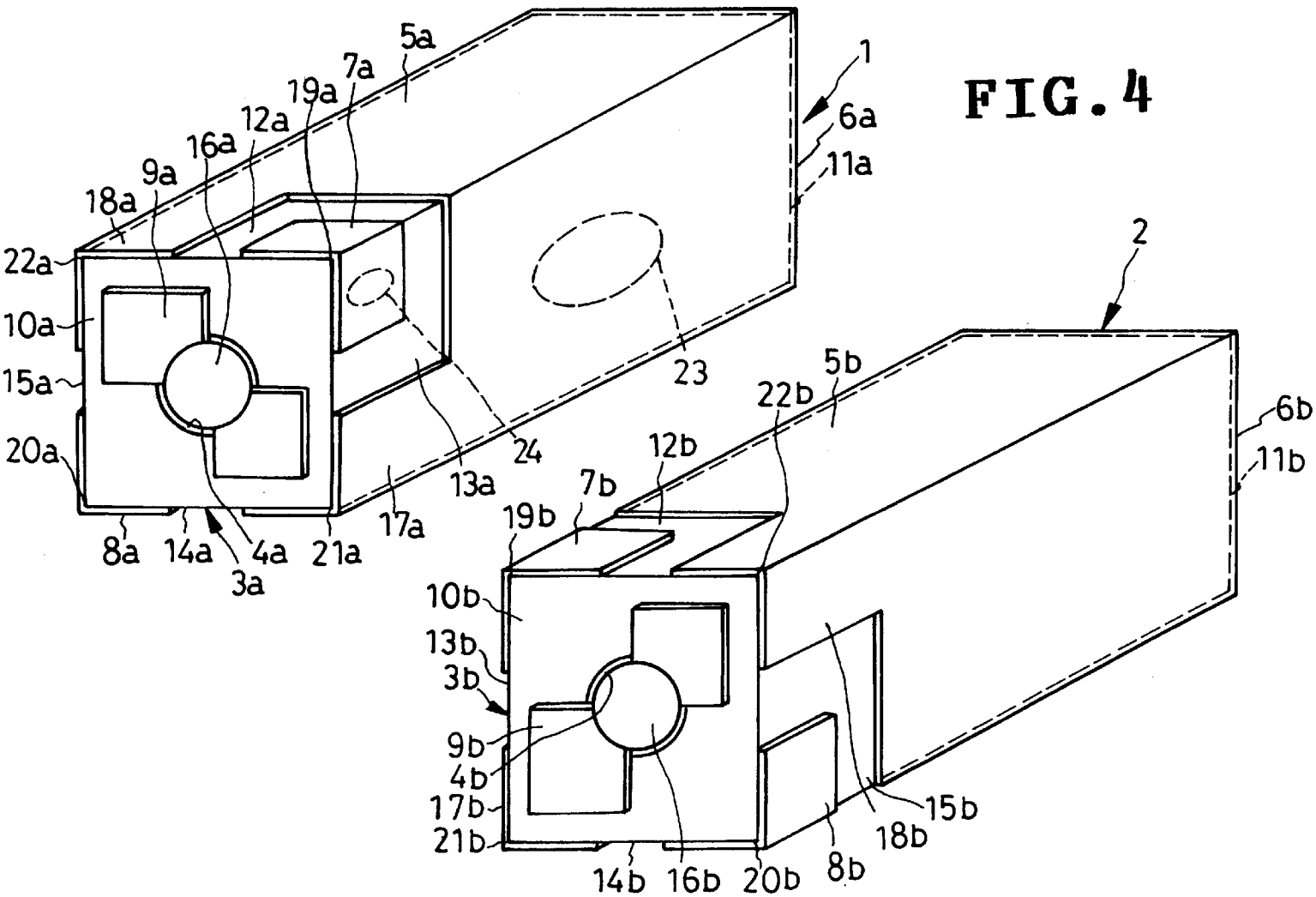
FIG. 4 is an exploded perspective view of the FIG. 1 filter.
Figure 5:
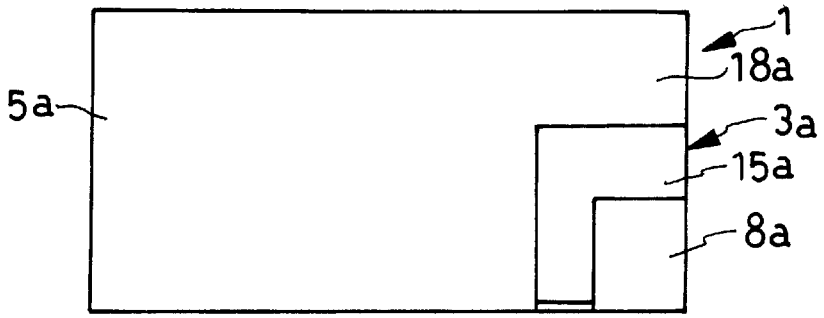
FIG. 5 is a left hand side elevation of the left hand resonator of the FIG. 1 filter.
Figure 6:
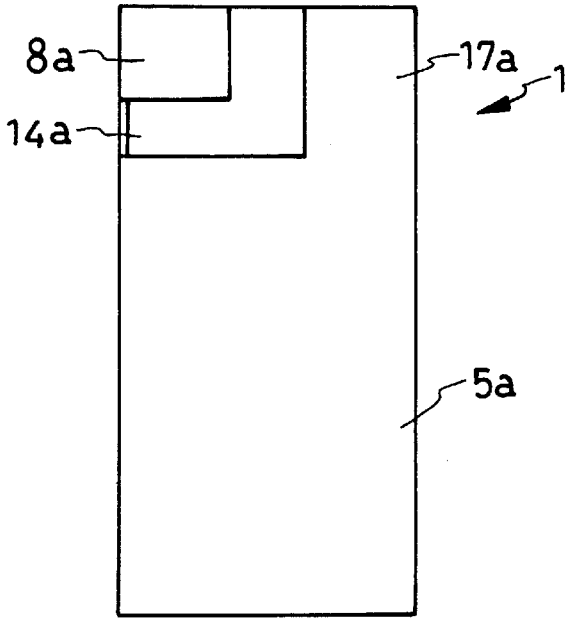
FIG. 6 is a bottom plan of the left hand resonator of the FIG. 1 filter.
Figure 7:
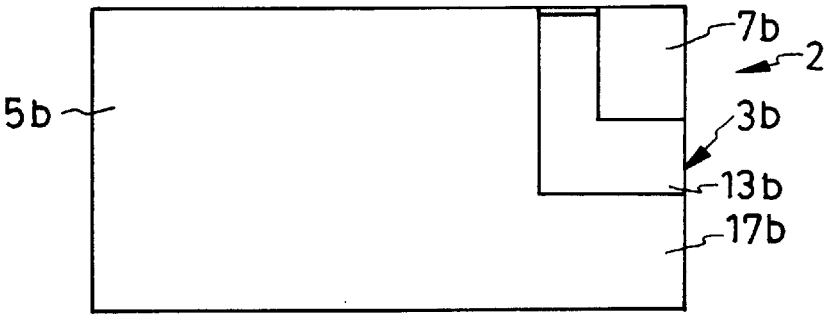
FIG. 7 is a left hand side elevation of the right hand resonator of the FIG. 1 filter.
Figure 8:
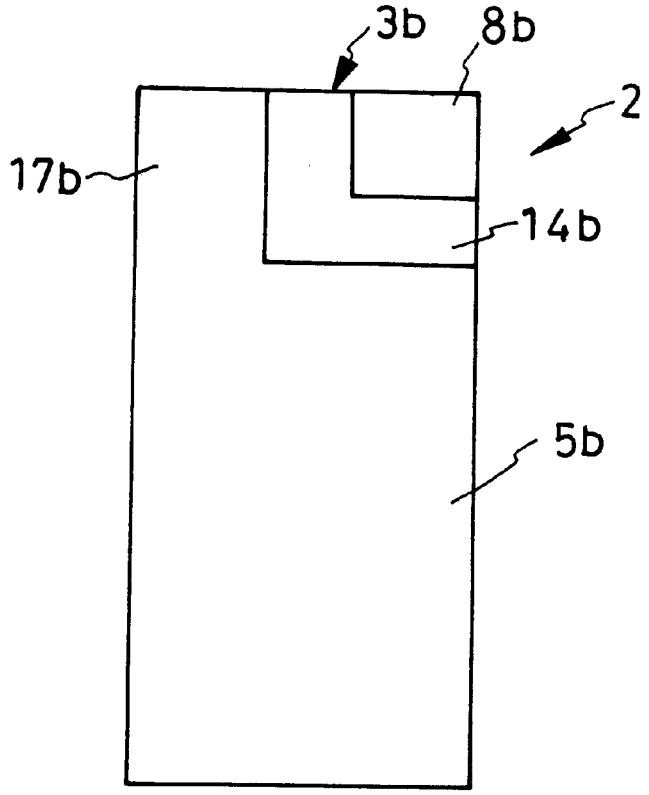
FIG. 8 is a bottom plan of the right hand resonator of the FIG. 1 filter.

An inspection of FIGS. 1 and 4 in particular will reveal that the resonator coupling conductors 7*a* and 7*b* and terminal conductors 8*a* and 8*b*, as well as the outer conductor first 17*a* and 17*b* and second 18*a* and 18*b* extensions, are configured in axial symmetry about the axes of the resonance holes 16*a* and 16*b*. The two dielectric resonators 1 and 2 can therefore be of identical make; only, they are coupled together with one resonator angularly displaced 90 degrees about the resonator axis from the other.

Before studying the inner conductor extensions 9*a* and 9*b* in detail, let us specify the four corners the dielectric bodies 3*a* and 3*b* as follows: the first corner 19*a* and 19*b* between the dielectric body first 12*a* and 12*b* and second 13*a* and 13*a* side surfaces, the second corner 20*a* and 20*b* between the dielectric body third 14*a* and 14*b* and fourth 15*a* and 15*b* side surfaces, the third corner 21*a* and 21*b* between the dielectric body second 13*a* and 13*a* and third 14*a* and 14*b* side surfaces, and the fourth corner 22*a* and 22*b* between the dielectric body first 12*a* and 12*b* sand fourth 15*a* and 15*b* side surfaces.

The inner conductor extensions 9*a* and 9*b* may be thought of as being each composed of two separate parts of virtually square shape, exist tending from the inner conductor 4*a* and, 4*b* toward, and terminating short of, the third 21*a* and 21*b* and fourth 22*a* and 22*b* corners of the dielectric body first end surfaces 10*a* and 10*b*. The arrangements of the inner conductor extensions 9*a* and 9*b* are such that they are each of bilateral symmetry both about a first diagonal line between the first 19*a* and 19*b* and second 20*a* and 20*b* corners and about a second diagonal line between the third 2 1*a* and 2 1*b* and fourth 22*a* and 22*b* corners.

Figure 9:
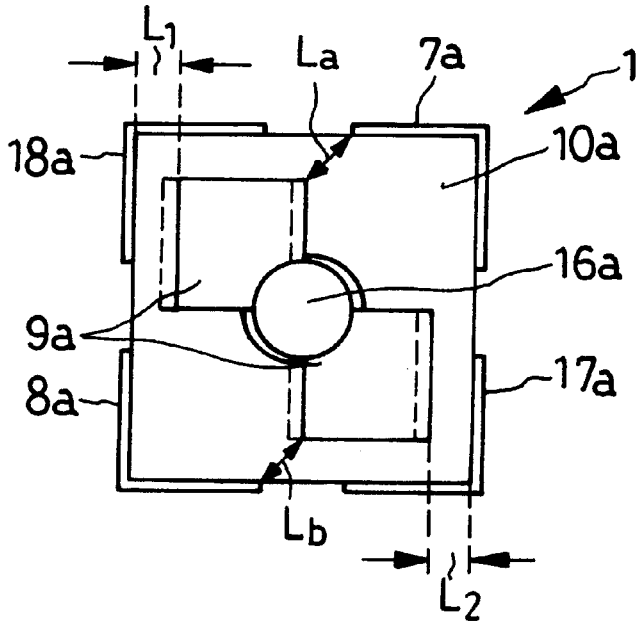
FIG. 9 is an end elevation of the left hand resonator of the FIG. 1 filter, the view being explanatory of the arrangement of the inner conductor extension on the end surface of the dielectric body.

FIG. 9 shows the geometry of the various conductors on the dielectric body first end surface 10*a* of only the first dielectric resonator 1, it being understood that the conductors on the dielectric body first end surface 10*b* of the second resonator 2 is of like arrangement. As indicated in this figure, the shortest distance La between resonator coupling conductor 7*a* and inner conductor extension 9*a*, and the shortest distance Lb between terminal conductor 8*a* and inner conductor extension 9*a*, are both longer than either of the shortest distance $L_1$ and $L_2$ between inner conductor extension 9*a* and outer conductor extensions 17*a* and 18*a*. The same dimensional relations apply, of course, to the conductors on the dielectric body first end surface 10*b* of the second dielectric resonator 2.

Further the inner conductor extensions 9*a* and 9*b* are so shaped, sized, and arranged that capacitances between inner conductor extensions 9*a* and 9*b* and resonator coupling conductors 7*a* and 7*b*, and capacitances between inner conductor extensions 9*a* and 9*b* and terminal conductors 8*a* and 8*b*, are both less than capacitances between inner conductor extensions 9*a* and 9*b* and outer conductor first 17*a* and 17*b* and second 18*a* and 18*b* extensions.

All the conductors on the dielectric bodies 3*a* and 3*a*, the inner conductors 4*a* and 4*b*, outer conductors 5*a* and 5*b*, resonator coupling conductors 7*a* and 7*b*, terminal conductors 8*a* and 8*b* inner conductor extensions 9*a* and 91; and outer conductor first 17*a* and 17*b* and second 18*a* and 18*b* extensions, can be formed by coating a pasted electroconductive material such as silver on the required parts of the dielectric bodies 3*a* and 3*b* and then by firing the coatings. Alternatively, the conductors on the dielectric bodies 3*a* and 3*b* may be created first by covering the complete surfaces of the dielectric bodies with a conductive material, either by coating and firing or by plating, and then by removing unwanted parts of the coatings or platings either by laser beam irradiation or by a cutting tool.

Figure 10:
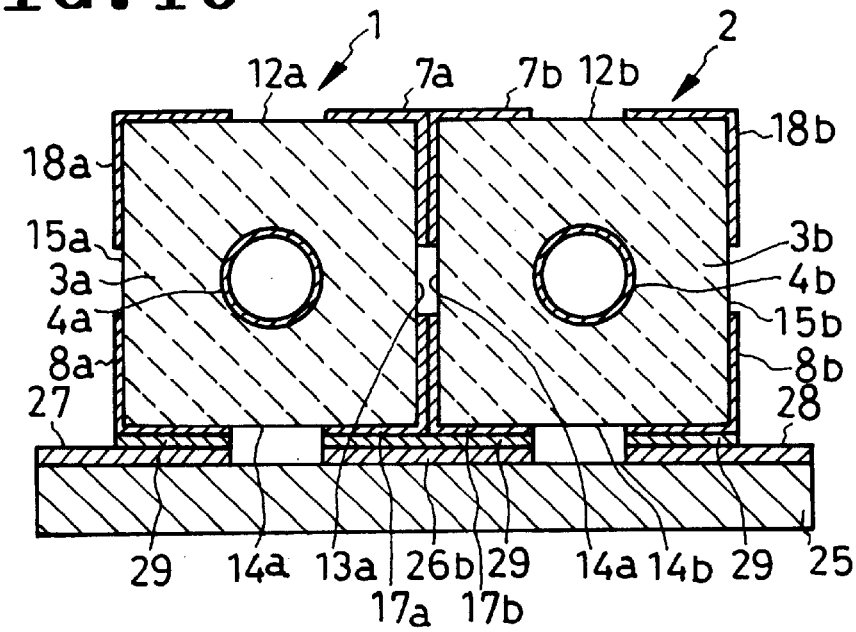
FIG. 10 is a sectional view showing the FIG. 1 resonators as mounted on a circuit board, the resonators being shown sectioned along the line B—B in FIG. 2.
Figure 11:
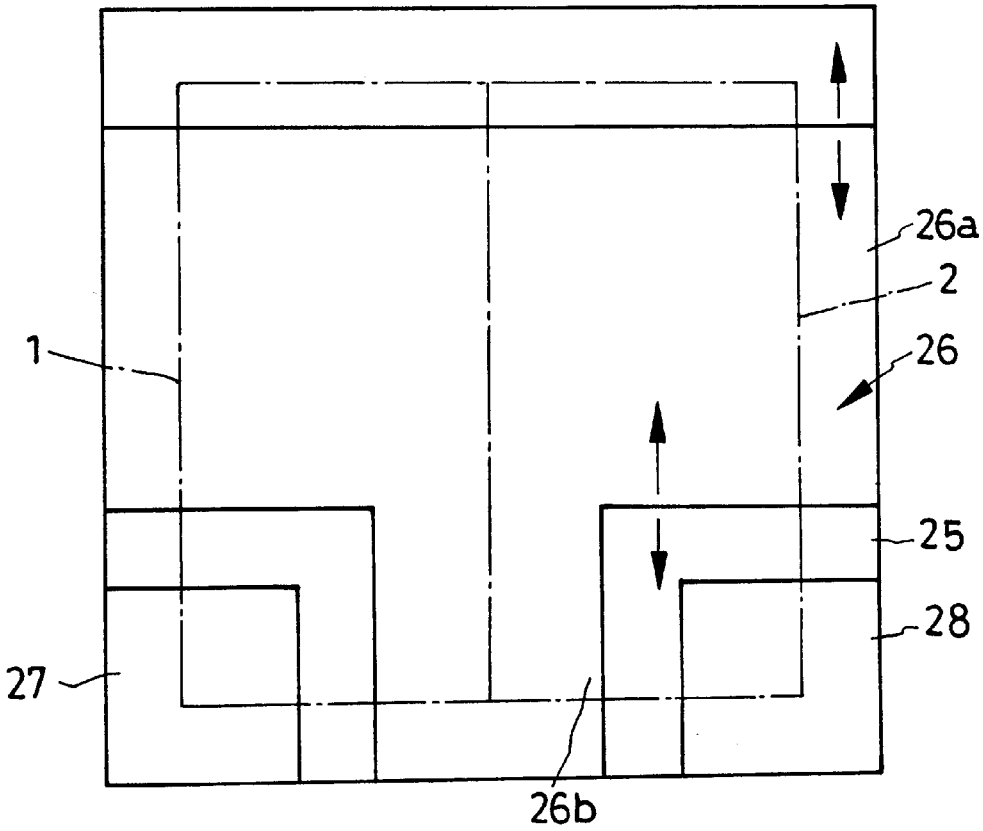
FIG. 11 is a top plan of the FIG. 10 circuit board.

Constructed and coupled together as in the foregoing, the pair of dielectric resonators 1 and 2 are usually mounted on a printed circuit board shown at 25 in both FIGS. 10 and 11. The circuit board 25, itself of electrically insulating material has printed on its major surface a grounding conductor layer 26 and two terminal conductor layers 27 and 28.

The grounding conductor layer 26 on the circuit board is generally in the shape of the capital T. having a first limb 26*a* for contact with the outer conductors 5*a* and 5*b* of both resonators 1 and 2, and a second limb 26*b* for contact with the outer conductor first extensions 17*a* and 17*b* of both resonators 1 and 2. The terminal conductor layers 27 and 28 are intended for contact respectively with the terminal conductors 8*a* and 8*b* of both resonators 1 and 2 and so shaped and sized as to fit those parts of the terminal conductors 8*a* and 8*b* which overlie the dielectric body third side surfaces 14*a* and 14*b*.

The resonators 1 and 2 are positioned on the circuit board 25 as indicated by the broken lines in FIG. 11. So positioned, the resonators are affixed to the circuit board 25 as by solder 29, FIG. 10, joining the outer conductors 5*a* and 5*b* and their extensions 17*a* and 17*b* to the grounding conductor layer 26, and the terminal conductors 8*a* and 8*b* to the terminal conductor layers 27 and 28.

Since the two dielectric resonators 1 and 2 of this representative wave filter are of like construction, either of the two terminal conductors 8*a* and 8*b* thereon can be an input, and the other an output. The same applies to the two terminal conductor layers 27 and 28 on the circuit board 25. Also notwithstanding the showings of FIGS. 10 and 11, the circuit board 25 may be variously modified to permit various other circuit components to be mounted thereon.

Figure 12:
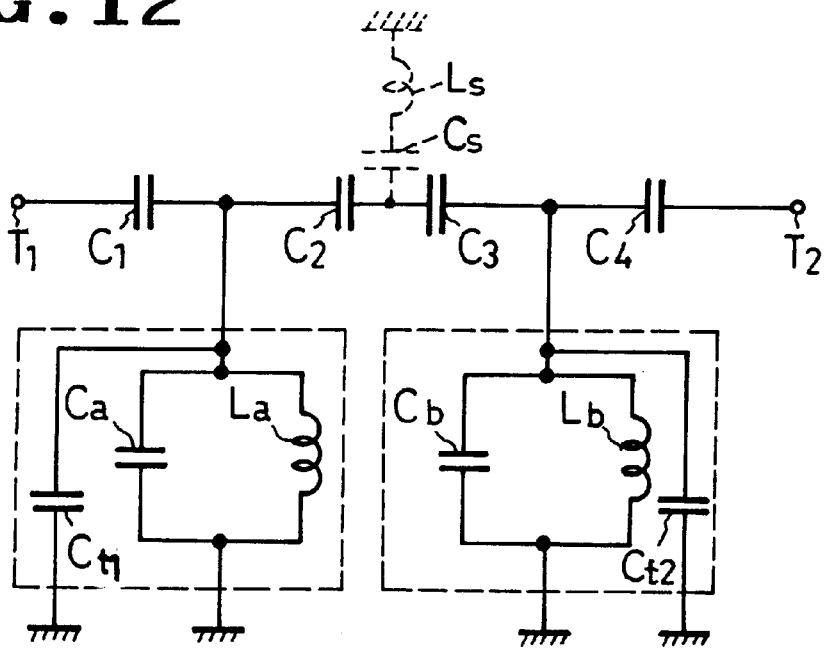
FIG. 12 is an equivalent circuit diagram of the FIG. 1 filter.

Reference is now directed to FIG. 12, an equivalent circuit diagram of the representative filter set forth above, for a discussion of the electrical details of the device. Terminals $T_1$ and $T_2$ in this diagram represent the terminal conductors 8*a* and 8*b* on the dielectric bodies 3*a* and 3*a*, or the terminal conductor layers 27 and 28 on the circuit board 25. Capacitors $C_1$ and $C_4$ represent the capacitances between terminal conductors 8*a* and 8*b* and inner conductors 4*a* and 4*b* together with their extensions 9*a* and 9*b*. Capacitors $C_2$ and $C_3$ represent the capacitances between resonator coupling conductors 7*a* and 7*b* and inner conductors 4*a* and 4*b* together with their extensions 9*a* and 9*b* L Capacitors $Ct_1$ and $Ct_2$. represent the sums of the capacitances between inner conductor extensions 9*a* and 9*b* and outer conductor extensions 17*a*, 17*b*, 18*a* and 18*b* and the capacitances between outer conductor extensions 17*a*, 17*b*, 18*a* and 18*b* and inner conductors 4*a* and 4*b* La, Lb, Ca and Cb represent the resonators proper of the two dielectric resonators 1 and 2. Connected in parallel with the parallel circuits of Ca and La and of Cb and Lb, respectively, the capacitors $Ct_1$ and $Ct_2$ function to achieve the aforementioned wavelength shortening effect.

Figure 13:
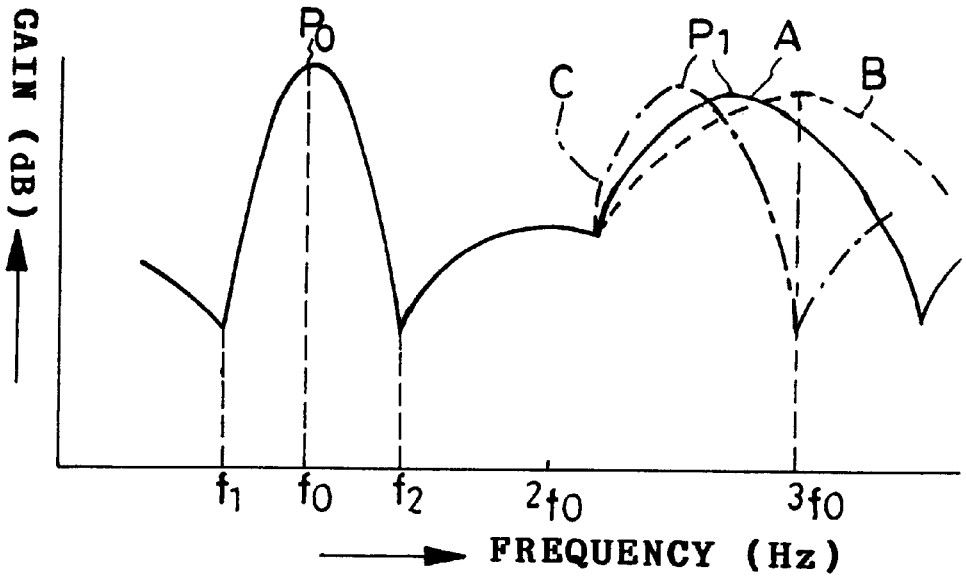
FIG. 13 is a graph plotting the curve of the gain of the FIG. 1 filter against the input frequency.

At A in the FIG. 13 graph is plotted the frequency characteristic of the above described representative wave filter. The main resonance peak P0 occurs at the fundamental frequency f0. providing a passband. The spurious resonance peak P1 occurs at slightly below the frequency 3f0, the third harmonic of the fundamental frequency f0.

Were it not for the outer conductor first 17*a* and 17*b* and second 18*a* and 18*b* extensions, the stray capacitances and stray inductances between resonator coupling conductors 7*a* and 7*b* and ground would be so low that the peak of the spurious resonance would remain virtually unaffected. The resulting filter characteristic would then be as indicated by the dashed line labeled B in FIG. 13, failing to sufficiently attenuate the third harmonic 3f0.

By contrast, thanks to the provision of the outer conductor first 17*a* and 17*b* and second 18*a* and 18*b* extensions, the stray capacitances between resonator coupling capacitors 7*a* and 7*b* and ground become so high that, in coaction with the stray inductances, they serve to lower the peak frequency of the spurious resonance from B to A in FIG. 13. Such stray capacitances and stray inductances are indicated at Cs and Ls in FIG. 12.

Possibly, some wave filters fabricated according to this invention may fail to offer the desired characteristics. Such failures are easy to occur because the dielectric bodies 3*a* and 3*b* take the form of ceramic moldings. which are notoriously susceptible to dimensional instability, and, as a natural consequence, because the various conductors on the ceramic bodies are just no less subject to errors in shape, size or position The following remedies are possible in such cases.

If the resonance frequency f0 is lower than the desired one, either the outer conductors 5*a* and 5*b* may be cut shorter, or either or both of the inner conductor extensions

9*a* and 9*b* and the outer conductor extensions 17*a*, 17*b*, 18*a* and 18*b* may be cut off to required extent For decreasing the capacitances of the capacitors $C_2$ and $C_3$ in FIG. 12, parts of the resonator coupling capacitors 7*a* and 7*b*, preferably their corners adjacent the outer conductors 5*a* and 5*b* may be removed Similarly, for decreasing the capacitances of the capacitors $C_1$ and $C_4$, parts of the terminal conductors 8*a* and 8*b* preferably their corners adjacent the outer conductors 5*a* and 5*b*, may be removed.

In order to change the limit frequencies f1 and f2 in FIG. 13, the pattern of the grounding conductor layer 26, FIG. 11, on the circuit board 25 may be altered as indicated by the arrows The limit frequencies f1 and fi will come closer to the resonance frequency f0 if the grounding conductor layer 26 is made smaller for less contact with the outer conductors 5*a* and 54*b*, and go away from the resonance frequency f0 if the grounding conductor layer is made larger for greater contact with the outer conductors.

The following is a summary of the advantages gained by the wave filter set forth above with reference to FIGS. 1–13:

1. Interposed between the terminal conductors 8*a* and 8*b*, as best depicted in FIG. 10, the outer conductor first extensions 17*a* and 17*b* function to shield the terminal conductors from each other, minimizing signal leakage from input to output. On the circuit board 25, too, the terminal conductor layers 27 and 28 are isolated from each other by the part 26*b* of the grounding conductor layer 26.

2. As the outer conductor first 17*a* and 17*b* and second 18*a* and 18*b* extensions and inner conductor extensions 9*a* and 9*b* provide the capacitors $Ct_1$, and $Ct_2$ FIG. 12, a lower resonance frequency is obtainable for the same length of the dielectric bodies 3*a* and 3*b*. In other words, a smaller filter is obtainable for a given resonance frequency.

3. The inner conductor extensions 9*a* and 9*b* are spaced from the resonator coupling capacitors 7*a* and 7*b* and terminal conductors 8*a* and 8*b*, so much so that little or no change in capacitances therebetween will occur even if the inner conductor extensions are formed displaced to the positions indicated by the dashed lines in FIG. 9. In this case, moreover, the distances $L_1$ between inner conductor extensions 9*a* and 9*b* and outer conductor extensions 18*a* and 18*b* will shorten whereas the distances $L_2$, between inner conductor extensions 9*a* and 9*b* and outer conductor extensions 17*a* and 17*b* will grow, but the sum of the distances $L_1$. and $L_2$ will be the same as if the inner conductor extensions are formed in the proper positions indicated by the solid lines. In short the filter will suffer no substantial change in characteristics from such displacement of the inner conductor extensions.

4. With the noted decrease in capacitances between inner conductor extensions 9*a* and 9*b* and resonator coupling conductors 7*a* and 7*b*, and those between inner conductor extensions and terminal conductors 8*a* and 8*b*, these resonator coupling conductors and terminal conductors can be made so large in size, for given values of the capacitors C1–C4, FIG. 12, as to permit easy and positive coupling of the resonators to each other and to external circuits.

Figure 14:
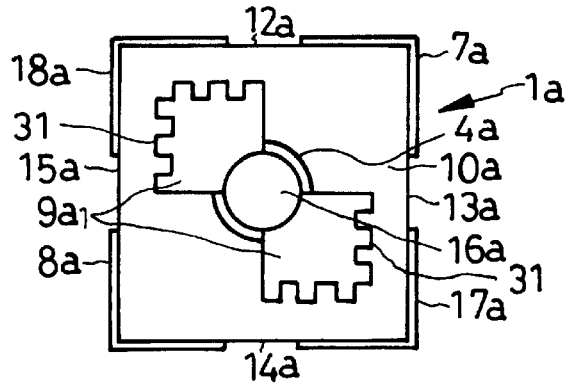
FIG. 14 is an end view of a dielectric resonator having a modified inner conductor extension according to this invention.

Embodiment of FIG. 14

Embodiments shown in FIGS. 14–17 are all alike in featuring inner conductor extensions of various modified shapes. Although these FIGS. show only first dielectric resonators 1*a*–1*b* it is understood that each of these resonators are to be combined, in the manner set forth in connection with the first disclosed embodiment, with another resonator of similar design to make up a filter in accordance with the invention. It is also understood that the resonators 1*a*–1*b* are identical with the above described resonators 1 and 2 in details other than the inner conductor extensions.

The FIG. 14 resonator la has an inner conductor extension $9a_1$, which is similar to its counterpart 9*a* of the FIG. 1 or 9 resonator 1 except that its two constituent portions of square shape are formed to include series of teeth 31 along their edges adjacent the outer conductor extensions 17*a* and 18*a*. These teeth are intended to be selectively removed for adjustment of the frequency characteristics of the filter.

Figure 15:
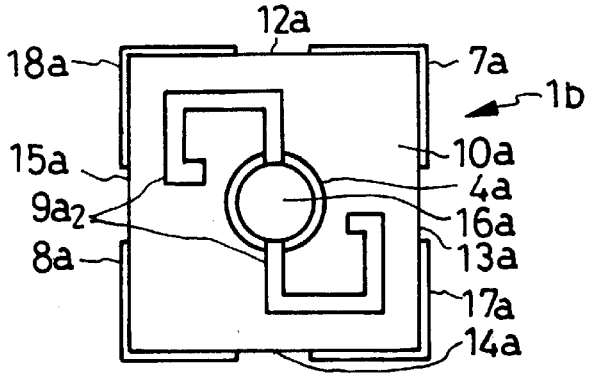
FIG. 15 is an end view of a dielectric resonator having another modified inner conductor extension according to this invention.

Embodiment of FIG. 15

The FIG. 15 resonator 1*b* features an inner conductor extension $9a_2$ in the shape of two strips each bent at three spaced points into an approximately square shape. So shaped, the inner conductor extension $9a_2$ function as both inductance element and capacitor. Consequently, the equivalent electric circuit of a filter comprised of two such dielectric resonators 1*b* needs modification of the FIG. 12 showing into one such that the capacitors $Ct_1$ and $Ct_2$ are connected, via inductance elements, in parallel with the Ca-La and Cb-Lb parallel circuits, respectively.

Figure 16:
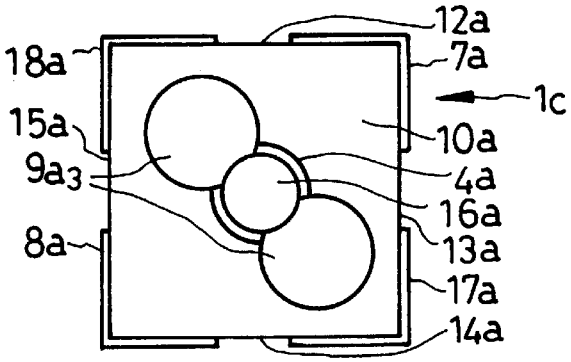
FIG. 16 is an end view of a dielectric resonator having still another modified inner conductor extension according to this invention.

Embodiment of FIG. 16

The FIG. 16 resonator 1*c* features an inner conductor extension $9a_3$ having two portions of circular shape in places of the square shaped portions of the inner conductor extension 9*a* of the FIGS. 1 or 9 resonator 1. The circular extensions perform the same functions as do the square or rectangular shaped ones.

Figure 17:
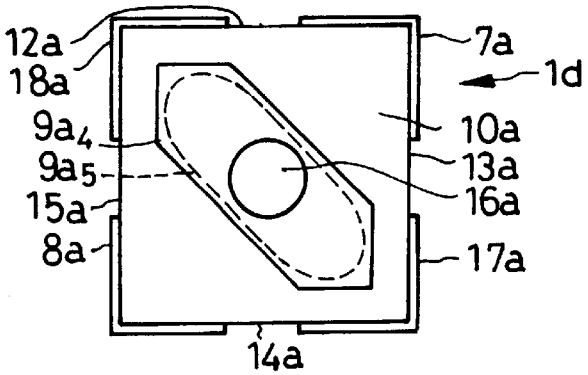
FIG. 17 is an end view of a dielectric resonator having a further modified inner conductor extension according to this invention.

Embodiment of FIG. 17

The FIG. 17 resonator 1*d* features an inner conductor extension $9a_4$ in the shape of a band with tapering ends. Essentially, this extension $9a_4$ is akin to the FIGS. 1 or 9 extension 9*a* except that the pair of square shaped portions of the latter are directly joined to each other. The double taper band extension $9a_4$, or an elliptic extension indicated by the dashed line in FIG. 17, perform the same functions as do the square or rectangular shaped ones.

Figure 18:
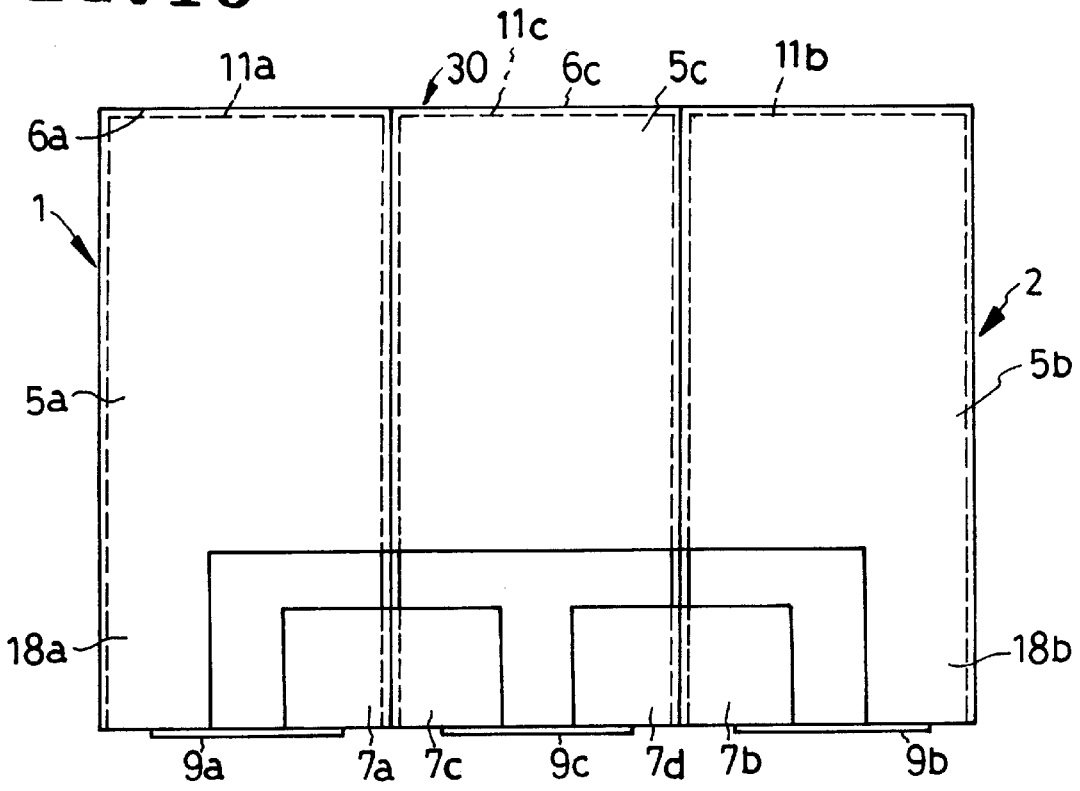
FIG. 18 is a top plan of another preferred form of dielectric filter according to this invention.
Figure 19:
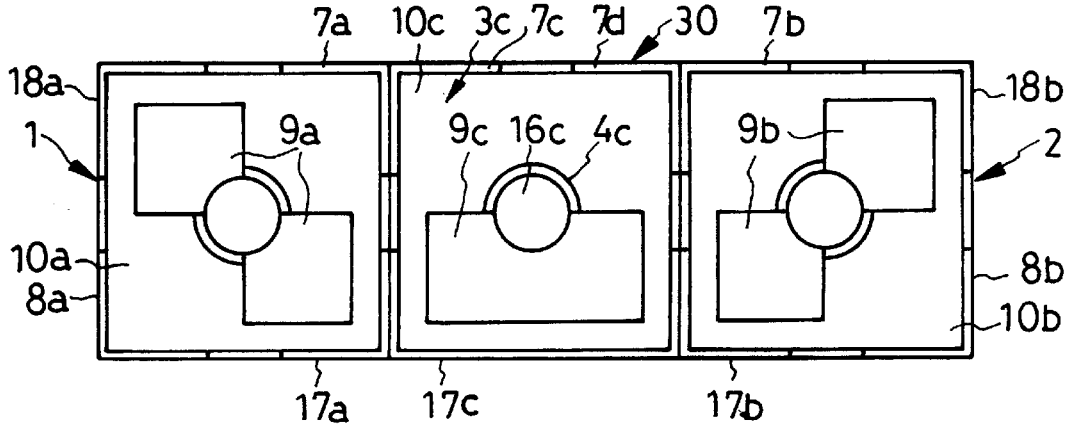
FIG. 19 is an end elevation of the FIG. 18 filter.
Figure 20:
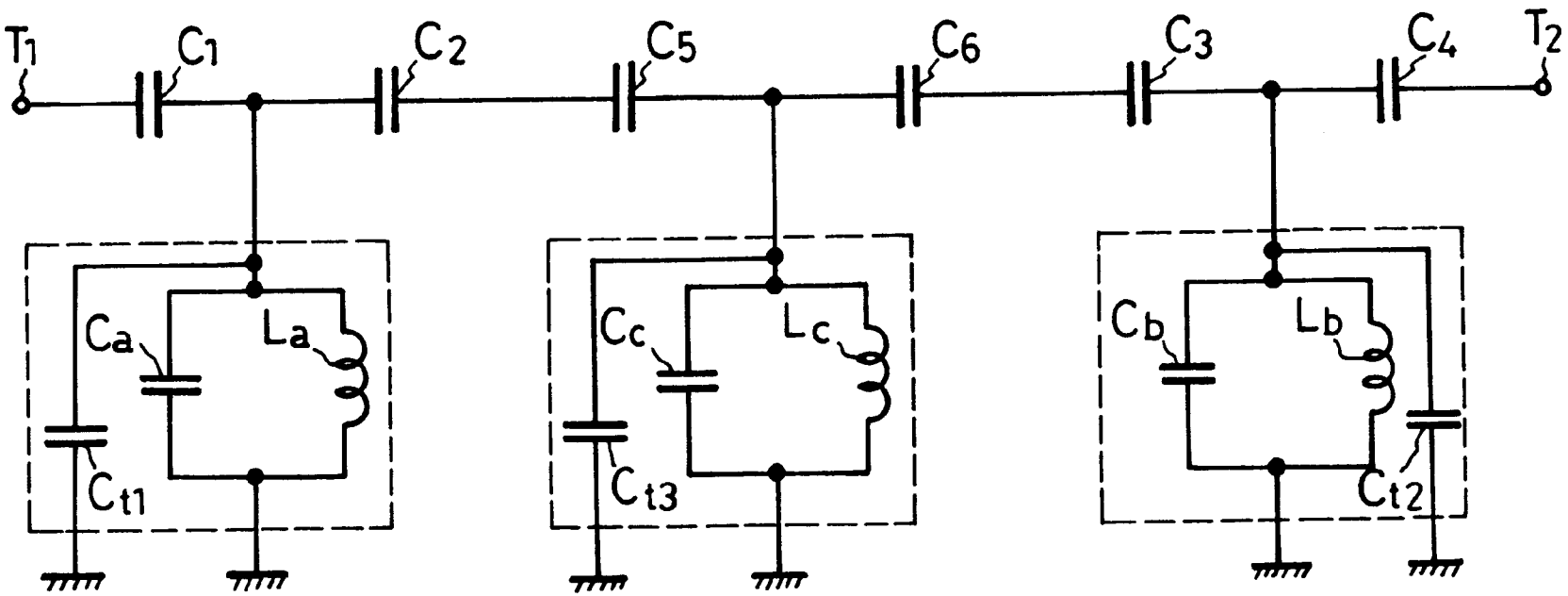
FIG. 20 is an equivalent circuit diagram of the FIG. 18 filter.

Embodiment of FIGS. 18–20

The wave filter seen in FIGS. 18 and 19 differs from all the foregoing embodiment in having three dielectric resonators in juxtaposition. For an easier understanding of this embodiment, the filter may be considered to have a third dielectric resonator 30 interposed between two resonators 1 and 2 of the same construction as in FIGS. 1–13.

The third or intermediate resonator 30 is similar to the other two resonators 1 and 2 in having a dielectric body 3*c* with a resonance hole 16*c* extending therethrough, an inner conductor 4*c* lining the surface of the resonance hole, an outer conductor 5*c* covering the outer surfaces of Is the dielectric body, leaving exposed their parts adjoining the dielectric body first end surface 10*c*, and a shorting conductor 6*c* on the dielectric body second end surface 11*c*. The third resonator 30 does, however, differ from the other two in having no terminal conductors and, instead, in having two resonator coupling conductors 7*c* and 7*d*, instead of one in each of the other two resonators, and an inner conductor extension 9*c* and outer conductor extension 17*c* which are both different in shape from their corresponding parts of the other two resonators.

The two resonator coupling conductors 7*c* and 7*d* are formed on subparts of the noted exposed parts of the top and both sides, as viewed in FIG. 19, of the dielectric body 3*c*. The inner conductor extension 9*c* is formed on part of the lower half, as seen in FIG. 19, of the dielectric body first end surface 10c The outer conductor extension 17*c* overlies the bottom surface and lower parts of the opposite side surfaces of the dielectric body 3*c*.

The three resonators 1, 2 and 30 are coupled together, both mechanically and electrically, by solder or like conductive bonding agent joining their outer conductors 5*a*, 5*b* and 5*c* and their resonator coupling conductors 7*a*, 7*b*, 7*c* and 7*d*.

Electrically, the three resonator filter of FIGS. 18 and 19 is configured as diagramed in FIG. 20. The capacitance Cc and inductance Lc in this diagram represent the resonance circuit due to the inner conductor 4*c* and outer conductor 5*c* of the middle resonator 30, and the capacitance $Ct_3$ is due to the inner conductor extension 9*c* and outer conduce tor extension 17*c* and intended for the wavelength shortening effect The capacitance $C_5$ represents that between the inner conductor 4*c* and resonator coupling conductor 7*c* of the middle resonator 30, and the capacitance $C_6$ that between the inner conductor 4*c* and resonator coupling conductor 7*d* of the middle resonator. The other electrical details of this filter are the same as those of the first disclosed device, as has been set forth with reference to FIG. 12.

It will be appreciated that the inner conductor extension 9*c* is spaced the greatest possible distance away from the resonator coupling conductors 7*c* and 7*d* in the third resonator 30. This positional relationship provides the same advantages as those pointed out in connection with the first embodiment.

Figure 21:
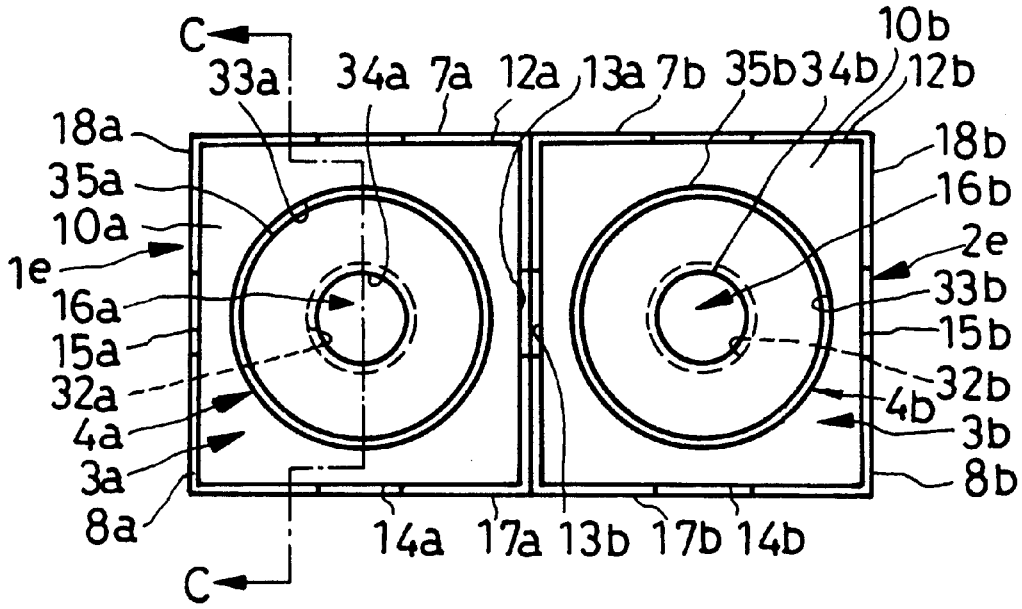
FIG. 21 is an end elevation of still another preferred form of dielectric filter according to this invention.
Figure 22:
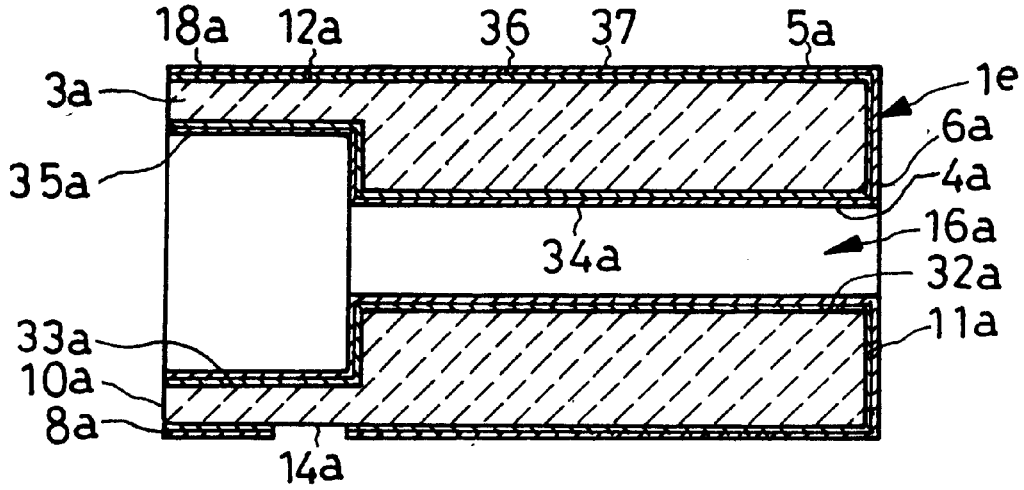
FIG. 22 is a section through one of the resonators of the FIG. 21 filter, taken along the line C—C in FIG. 21.
Figure 23:
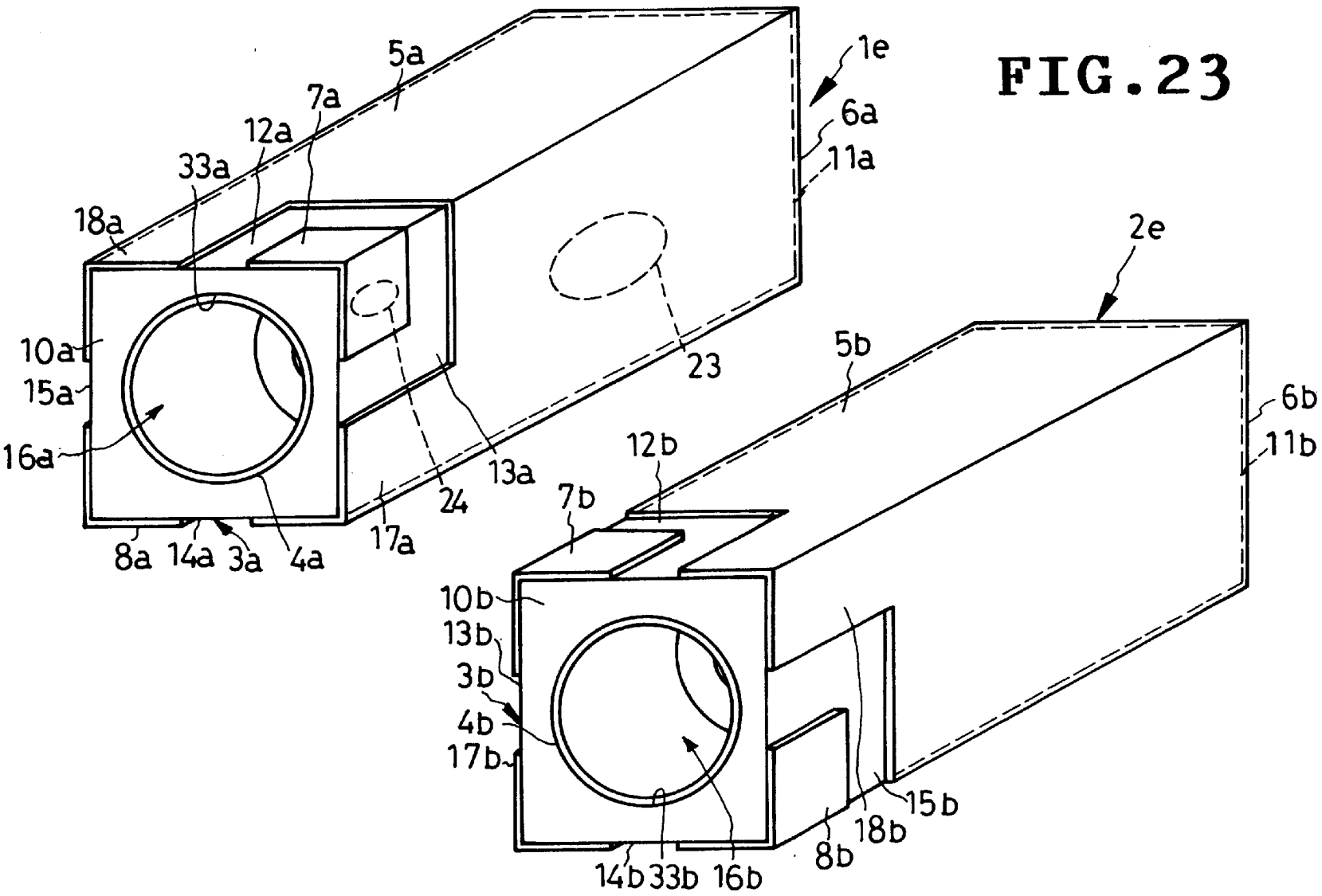
FIG. 23 is an exploded perspective view of the FIG. 21 filter.

Embodiment of FIGS. 21–23

The wave filter seen in FIGS. 21–23 is similar to the FIGS. 1–13 filter in having a pair of dielectric resonators 1*e* and 2*c* coupled together, so that the FIGS. 21–23 device will be best understood by comparison with the FIGS. 1–13 one FIG. 21 corresponds to FIG. 1, FIG. 22 to FIG. 3, and FIG. 23 to FIG. 4.

Constructionally, the resonators 1*e* and 2*e* of the FIGS. 21–23 filter are similar to the resonators 1 and 2 of the FIGS. 1–13 device except the following two points:

1. The resonators 1*e* and 2*e* have no inner conductor extensions; instead, the resonance holes 16*a* and 16*b* are constituted of smaller diameter portions 32*a* and 32*b* and larger diameter portions 33*a* and 33*a* in axial alignment.

2. All the conductors 4*a*, 4*b*, 5*a*, 6*a*, 6*b*, 7*a*, 7*b*, 8*a*, 8*b*, 17*a*, 17*b*, 18*a* and 18*b* of the resonators 1*e* and 2*e* are of two layers, as indicated by way of example at 36 and 37 in FIG. 22 for the outer conductor 5*a* of the resonator 1*e*.

The larger diameter portions 33*a* and 33*b* of the resonance holes 16*a* and 16*b* lie next to the first end surfaces 10*a* and 10*b* of the dielectric bodies 3*a* and 3*a* i and the smaller diameter portions 32*a* and 32*b* next to the second end surface 11*a* and 11*b*. The axial dimension of the resonance hole larger diameter portions 33*a* and 33*b* is greater than the a dimensions of the resonator coupling conductors 7*a* and 7*b* and of the terminal conductors 8*a* and 8*b* in the axial direction of the resonance holes 16*a* and 16*b* Consequently, the distance between the resonator coupling conductors 7*a* and 7*b* and the inner conductor portions 35*a* and 35*b* lining the resonance hole larger diameter portions 33*a* and 33*b* is wholly less than the distance between the outer conductors 5*a* and 5*b* and the inner conductor portions 34*a* and 34*b* lining the resonance hole smaller diameter portions 32*a* and 32*b*.

From the foregoing positional and dimensional relations it is possible to make greater the capacitances $C_1$, $C_2$, $C_3$ and $C_4$ in FIG. 12. In cases where such larger capacitances are not needed, the resonators 1*e* and 2*e* may be made more compact through size reduction of the resonator coupling conductors 7*a* and 7*b* and terminal conductors 8*a* and 8*b*. The provision of the resonance hole larger diameter portion 33*a* and 33*b* serves the additional purpose of improving the wavelength shortening effect.

According to the second recited feature of the FIGS. 21–23 filter, all the conductors 4*a*, 4*b*, 5*a*, 5*b*, 6*a*, 6*b*, 7*a*, 7*b*, 8*a*, 8*b*, 17*a*, 17*b*, 18*a* and 18*b* of the resonators 1*e* and 2*e* are each of two layers, the baked on first layer 36 and the plated-on second layer 37. Typically, the first layer 36 is formed by coating a silver paste on the required parts of the dielectric bodies 3*a* and 3*b* and firing the coatings. A metal is then plated on the silver layers. The two-layer conductors serve to improve the electrical characteristics of the filter through reduction of their resistances, besides enhancing the mechanical strength.

Figure 24:
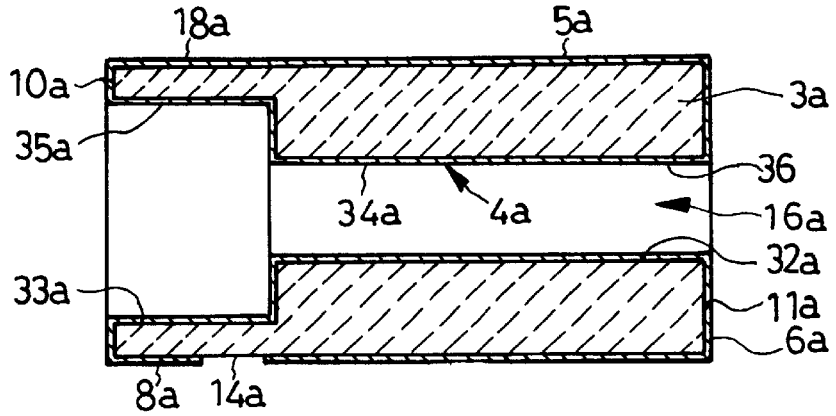
FIG. 24 is an axial section through one of the dielectric resonators of the FIG. 21 filter, the view showing a step in the fabrication of the filter.
Figure 25:
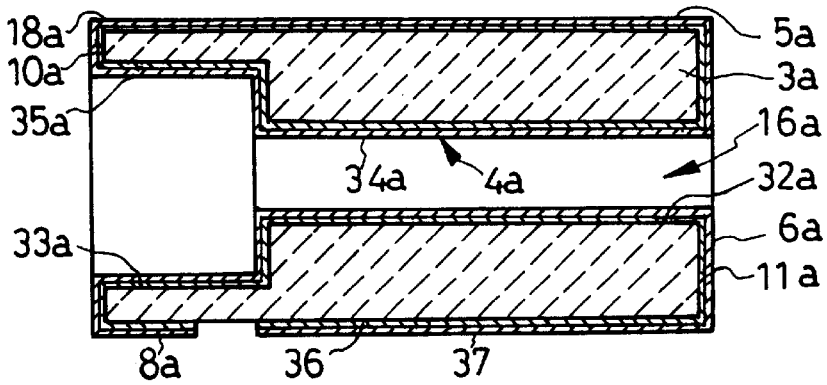
FIG. 25 is a view similar to FIG. 24 but showing another step in the fabrication of the FIG. 21 filter.
Figure 26:
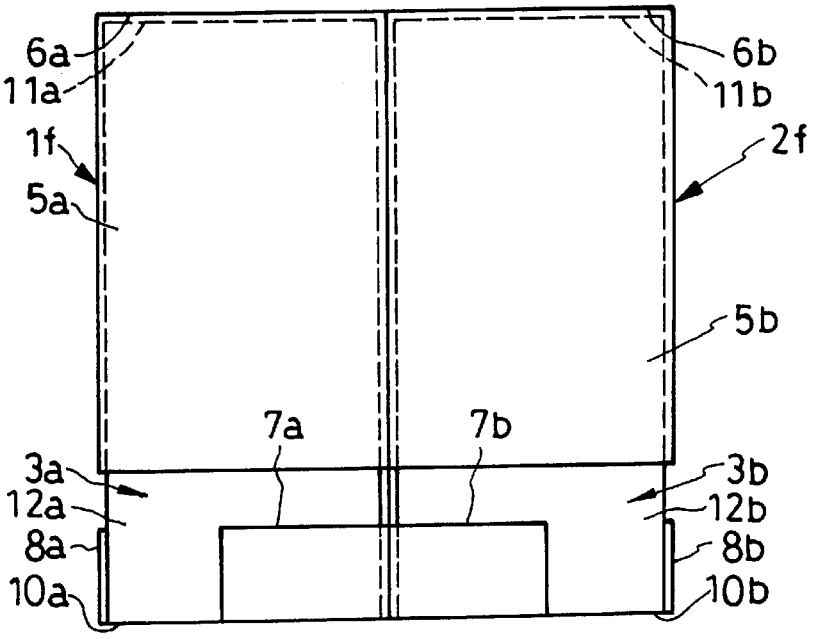
FIG. 26 is a top plan of yet another preferred form of dielectric filter according to this invention.

FIGS. 24 and 25 are explanatory of a preferred method of creating the two-layer conductors on the dielectric bodies 3*a* and 34 taking, however, only the dielectric body 3*a* for example A silver paste may first be printed not only on those parts of the surfaces of the dielectric body 3*a* where the conductors 4*a*, 5*a*, 6*a*, 7*a*, 8*a*, 17*a* and 18*a* are to be formed, but also on the first end surface 10*a* of the dielectric body. Then the printings may be fired, thereby forming the first layers 36 of the inner conductor 4*a*, outer conductor 5*a*, shorting conductor 6*a*, resonator coupling conductor 7*a*, terminal conductor 8*a*, and outer conductor extensions 17*a* and 18*a*, as well as of an additional conductor on the dielectric body first end surface 10*a*, as illustrated in FIG. 24. Then the second layers 37 may be formed on the first layers 36 by barrel plating, a known type of electroplating method, as in FIG. 25.

The resonance hole larger diameter portion 33*a* is relatively small in area. However, since the first conductor layer 36 preformed on this portion is joined via that on the dielectric body first end surface 10*a* to the first conductor layers of the resonator coupling conductor 7*a*, terminal conductor 8*a*, and outer conductor extensions 17*a* and 18*a*, the total area of these first conductor layers is large enough to permit the second conductor layer to be favorably created thereon by barrel plating.

Then the conductor layers on the dielectric body first end surface 10*a* may be ground off to complete the first dielectric resonator 1*e* shown in FIGS. 21 and 22. The second resonator 2*e*, being of exactly the same construction as the first 1*e*, can be fabricated by exactly the same method.

As an alternative method of fabricating the FIGS. 21–23 filter, the FIG. 24 article may be coupled to another such article. Then the second conductor layers 37, FIG. 25, may be plated on the first conductor layers 36 of both articles that have been coupled together. Then the conductor layers 36 and 37 may be ground off the dielectric body first end surfaces 10*a* and 10*b* of both articles, thereby completing the FIGS. 21–23 filter.

This alternative method offers the advantage that the removal of the conductor layers 36 and 37 from the dielectric body first end surfaces 10*a* and 10*b* can be practically concurrent with the fine tuning of the resonance frequency through grinding of the dielectric body first end surfaces.

Embedment of FIGS. 26–32

The resonators 1*f* and 2*f* of the FIGS. 26–32 filter are akin to the resonators 1 and 2 of the FIGS. 1–13 filter except for the following two dissimilarities:

1. The inner conductor extensions 9*a* and 9*b* and outer conductor second extensions 18*a* and 18*b* of the FIGS. 1–13 resonators 1 and 2 are both absent from the FIGS. 26–32 resonators 1*f* and 2*f*.

2. The remaining outer conductor extensions 17*a* and 17*b*, referred as the first extensions in the FIGS. 1–13 filter, of the FIGS. 26–32 resonators 1*f* and 2*f* are recessed at 40*a*, FIG. 27, and 40*b*, FIG. 30.

Figure 27:
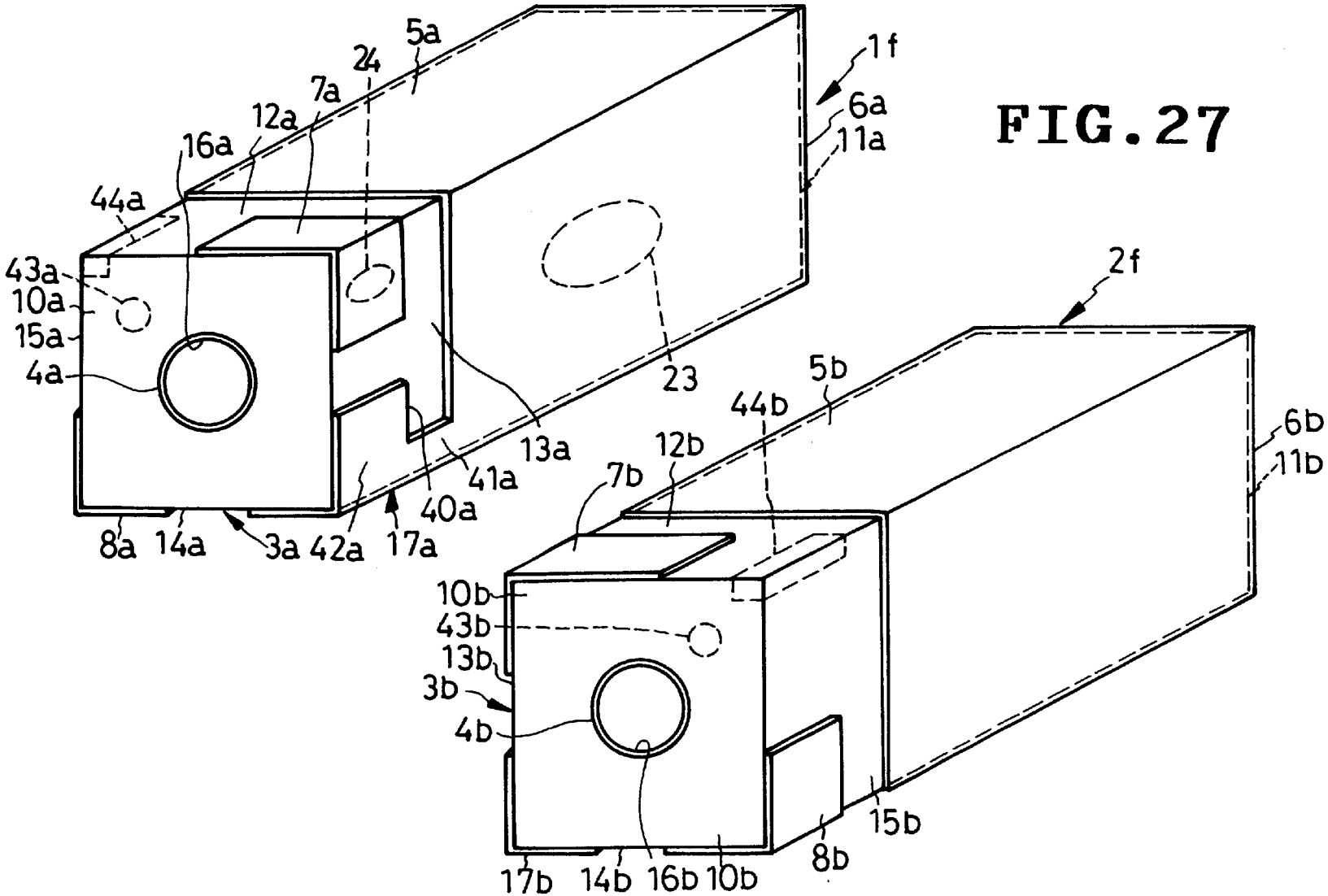
FIG. 27 is an exploded perspective view of the FIG. 26 filter.
Figure 28:
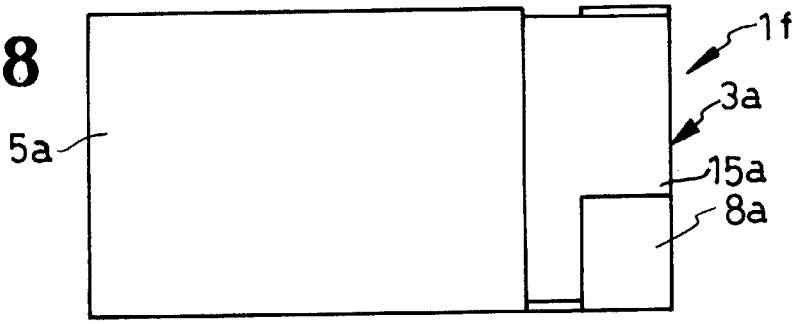
FIG. 28 is a left hand side elevation of the left hand resonator of the FIG. 26 filter.
Figure 30:
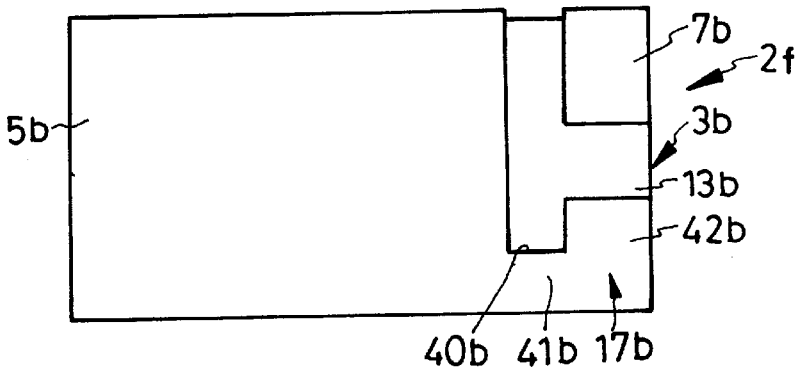
FIG. 30 is a left hand side elevation of the right hand resonator of the FIG. 26 filter.

As will be understood from both FIGS. 27 and 30, the recesses 40*a* and 40*b* are formed in those parts of the outer conductor extensions 17*a* and 17*b* which overlie the dielectric body second side surfaces 13*a* and 13*a*, and lie next to the outer conductors 5*a* and 5*b*. The dimension of the recesses 40*a* and 40*b* in a direction parallel to the resonance hole axis is less than that of the outer conductor extensions 17*a* and 17*b*, so that the outer conductor extensions on the dielectric body second side surfaces 13*a* and 13*a* are comprised of a constricted neck 4 1*a* or 4 1*b* and a head 42*a* or 42*h*. The outer conductor extension heads 42*a* and 42*b* are the same as the resonator coupling conductors 7*a* and 7*b* and terminal conductors 8*a* and 8*b* in dimension in a direction parallel to the resonator hole axis. The heads 42*a* and 42*b* intervene between the terminal conductors 8*a* and 8*b*, effectively isolating them from each other.

Figure 29:
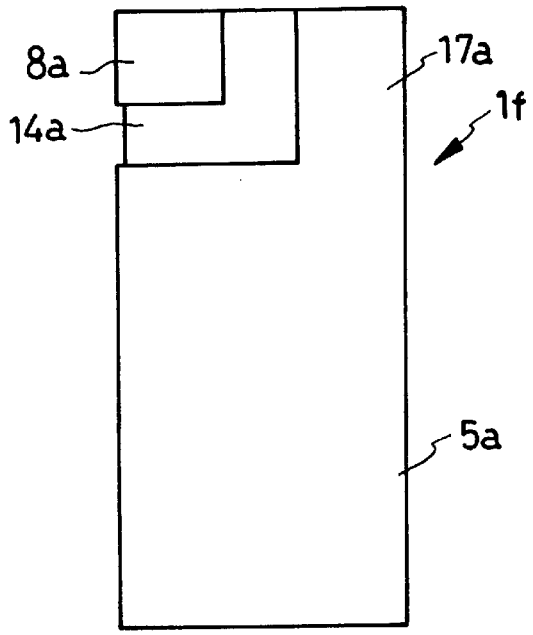
FIG. 29 is a bottom plan of the left hand resonator of the FIG. 26 filter.
Figure 31:
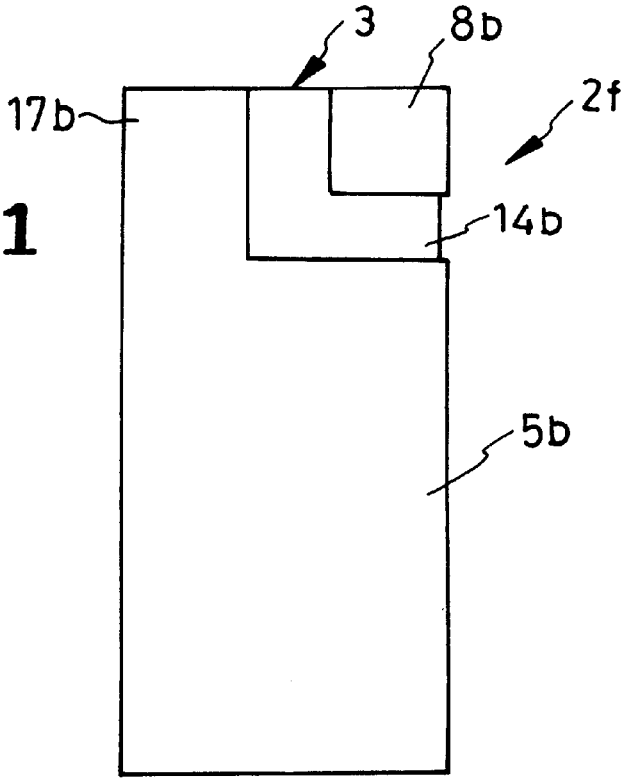
FIG. 31 is a bottom plan of the right hand resonator of the FIG. 26 filter.

The conductor patterns on the dielectric body third or bottom surfaces 14*a* and 14*b* are as pictured in FIGS. 29 and 31. A comparison of these figures with FIGS. 6 and 8 will show that the bottom conductor patterns of the FIGS. 26–32 resonators 1*f* and 2*f* are the same as those of the FIGS. 1–13 resonators 1 and 2 The resonators 1*f* and 2*f* may therefore be mounted to the circuit board 25, FIGS. 10 and 11, by the same method as are the resonators 1 and 2.

Figure 32:
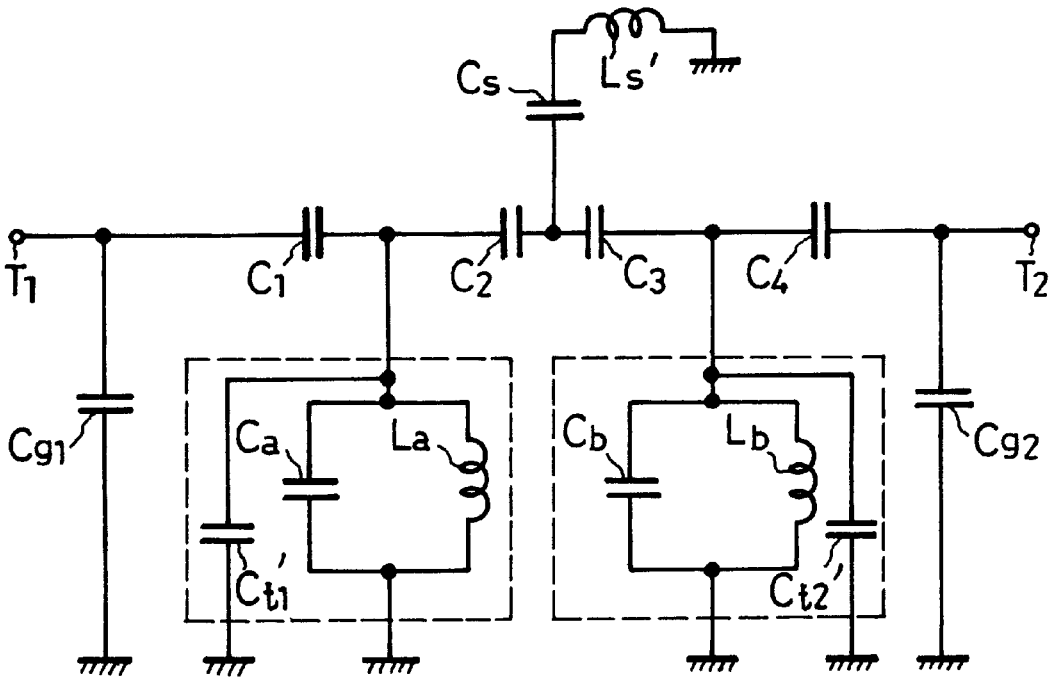
FIG. 32 is an equivalent circuit diagram of the FIG. 26 filter.

In FIG. 32 is given the equivalent electric circuit diagram of the FIGS. 26–31 filter, in which parts having their counterparts in the FIG. 12 diagram are designated by like indicia. Inductance Ls' shown connected in series with capacitance Cs includes components due to the necks 4 1*a* and 4 1*b* of the outer conductor extensions 17*a* and 17*b*, therefore, the FIG. 32 inductance Ls' is greater than the FIG. 12 inductance Ls.

Like the FIG. 12 capacitance $C_3$, the FIG. 32 capacitance $C_3$ is due to the resonator coupling conductors 7*a* and 7*b* and outer conductor extensions 17*a* and 17*b*. Since the outer conductor extension heads 42*a* and 42*b* are the same as aforesaid with the resonator coupling conductors 7*a* and 7*b* in dimension in a direction parallel to the resonance hole axis, the FIG. 32 capacitance $C_3$ is approximately equal to the FIG. 12 capacitance Cs.

The capacitances $Cg_1$ and $Cg_2$ seen in FIG. 32 represent those between terminal conductors 8*a* and 8*b* and outer conductor extensions 17*a* and 17*b* FIG. 12 omits the showing of these capacitances.

As indicated by the dot-and-dash curve C in FIG. 13, the peak $P_1$ of the spurious resonance of the FIGS. 26–32 filter will become lower if the inductance Ls' of FIG. 32 is appropriately determined through adjustment of the position and size of the recesses 40*a* and 40*b* in the outer conductor extensions 17*a* and 17*b*. The extreme attenuation frequency above this spurious resonance peak $P_1$ can thus be set at or near the third harmonic $3f_o$, of the fundamental frequency $f_o$. The third harmonic can be most effectively suppressed in this manner.

In fabricating the FIGS. 26–32 filter the outer conductor extensions 17*a* and 17*b* with the constricted necks 4 1*a* and 4 1*b* may be formed simultaneously with the outer conductors 5*a* and 5*b* by printing a pasted conductor. Then, if the printed conductor patterns have proved not to provide the desired inductance, the outer conductor extensions 17*a* and 17*b* may be made shorter as by a laser beam or a grinding tool.

Optionally, as indicated by the broken lines in FIG. 27, additional holes 43*a* and 43*a* for adjustment of the frequency characteristic may be formed in the first end faces 10*a* and 10*b* of the dielectric bodies 3*a* and 3*a* and parallel to the resonance holes 16*a* and 16*b*. For the same purpose, as also indicated by the broken lines in the same figure, recesses 44*a* and 44*b* may be formed in the dielectric bodies 3*a* and 3*a*. These holes 43*a* and 43*a* and recesses 44*a* and 44*b* serve to reduce the stray capacitances between resonator coupling conductors 7*a* and 7*b* and terminal conductors 8*a* and 8*b*. The reduction of the stray capacitances serve, in turn, to make lower the extreme attenuation frequency $f_1$ of FIG. 13 and to make greater the amount of attenuation at that extreme frequency.

Figure 33:
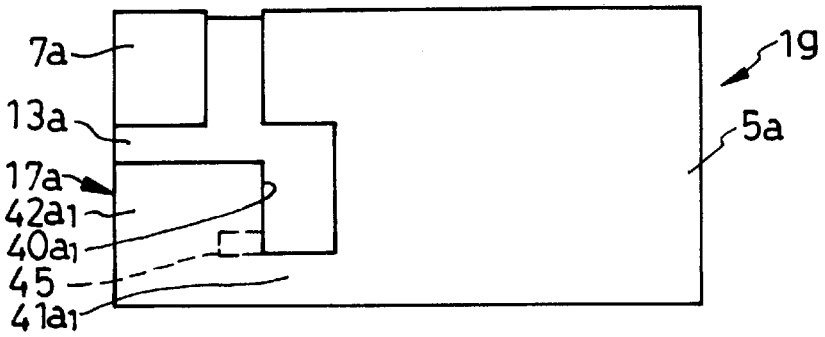
FIG. 33 is a side elevation of a dielectric resonator having a modified outer conductor and a modified extension therefrom according to this invention.

Embodiment of FIG. 33

FIG. 33 shows a modification 1*g* of the first dielectric resonator 1*f* of the FIGS. 26–32 filter, to be combined with another similarly modified resonator, not shown, to make up a wave filter in accordance with the invention. The modified resonator 1*g* features a recess $\mathbf{40}a_1$ which is formed in the outer conductor 5*a*, instead of in the outer conductor extension 17*a* as in FIG. 27. Thus the outer conductor extension 17*a*, or its head $\mathbf{42}a_1$, is of substantially the same size as the outer conductor first extension 17*a* of the FIGS. 1–13 filter, and is joined to the outer conductor 5*a* via a neck $\mathbf{41}a_1$, although this neck may be considered part of the outer conductor rather than of the extension 17*a*.

Thanks to the inductance due to the necks 4 1*a*, of this 1*g* and other unshown resonators the FIG. 33 filter gains the same advantages as the FIGS. 26–32 filter.

Optionally, as indicated by the broken lines designated 45 in FIG. 33, the recess $\mathbf{40}a_1$ may be enlarged into the outer conductor extension 17*a* for a higher inductance.

Figure 34:
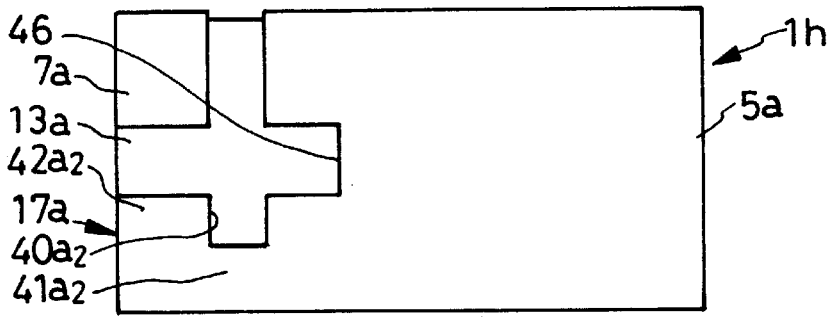
FIG. 34 is a side elevation of a dielectric resonator having another modified outer conductor and a modified extension therefrom according to this invention.

Embodiment of FIG. 34

FIG. 34 shows another modification 1*h* of the first dielectric resonator if of the FIGS. 26–32 filter, also to be combined with another similarly modified resonator, not shown, to make up a wave filter in accordance with the invention. The modified resonator 1*h* features a second recess 46 which is formed in the outer conductor 5*a* in addition to the first recess $\mathbf{40}a_2$ formed in the outer conductor extension 17*a*. Thus the outer conductor extension 17*a* is itself similar to that of the FIG. 27 resonator 1*f*, being comprised of the constricted neck $\mathbf{41}a_2$ and head $\mathbf{42}a_2$.

As in the FIGS. 26–32 filter, the peak of spurious resonance can be made to occur at a lower frequency than heretofore by virtue of not only the inductance due to the necks $\mathbf{41}a_2$ but also that due to the second recesses 46, of this 1*h* and other unshown resonator.

Figure 35:
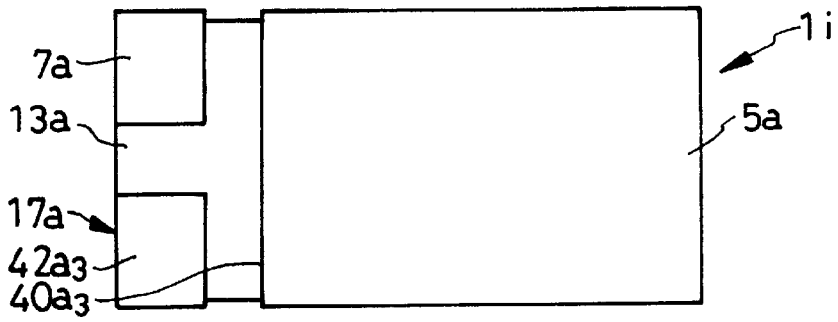
FIG. 35 is a side elevation of a dielectric resonator having still another modified outer conductor extension according to this invention.
Figure 36:
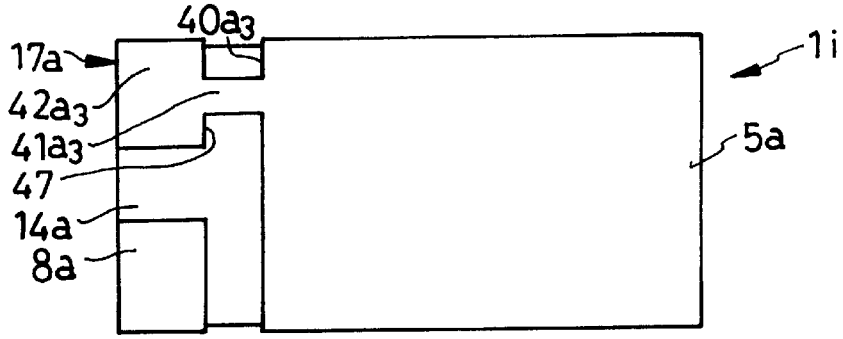
FIG. 36 is a bottom plan of the FIG. 35 resonator.

Embodiment of FIGS. 35 and 36

FIG. 35 shows the second side surface 13*a*, and FIG. 36 the third side surface or bottom 14*a*, of still another modification 1*i* of the first dielectric resonator 1*f* of the FIGS. 26–32 filter. This modified resonator 1*i* is also to be combined with another similarly modified resonator, not shown, to make up a wave filter in accordance with the invention.

With reference first to FIG. 35 it will be noted that that part of the outer conductor extension 17*am*, or of its head $42a_3$, which overlies the dielectric body second side surface is wholly separated from the outer conductor 5*a*; that is, the recess $40a_3$ extends down to the bottom of the dielectric body. Reference to FIG. 36 will then reveal that the recess $40a_3$ extends farther beyond the corner between the dielectric body second 13*a* and third 14*a* side surfaces. As another recess 47 is formed on the dielectric body third side surface 14*a*, a neck $41a_3$ is left between the recesses $40a_3$ and 47, joining the outer conductor 5*a* to that part of the outer conductor extension head $42a_3$ which overlies the dielectric body third side surface.

As in the FIGS. 26–32 filter, the peak of spurious resonance can be made to occur at a lower frequency than heretofore by virtue of the inductance due to the necks $41a_3$ of this is and other unshown resonators.

Figure 37:
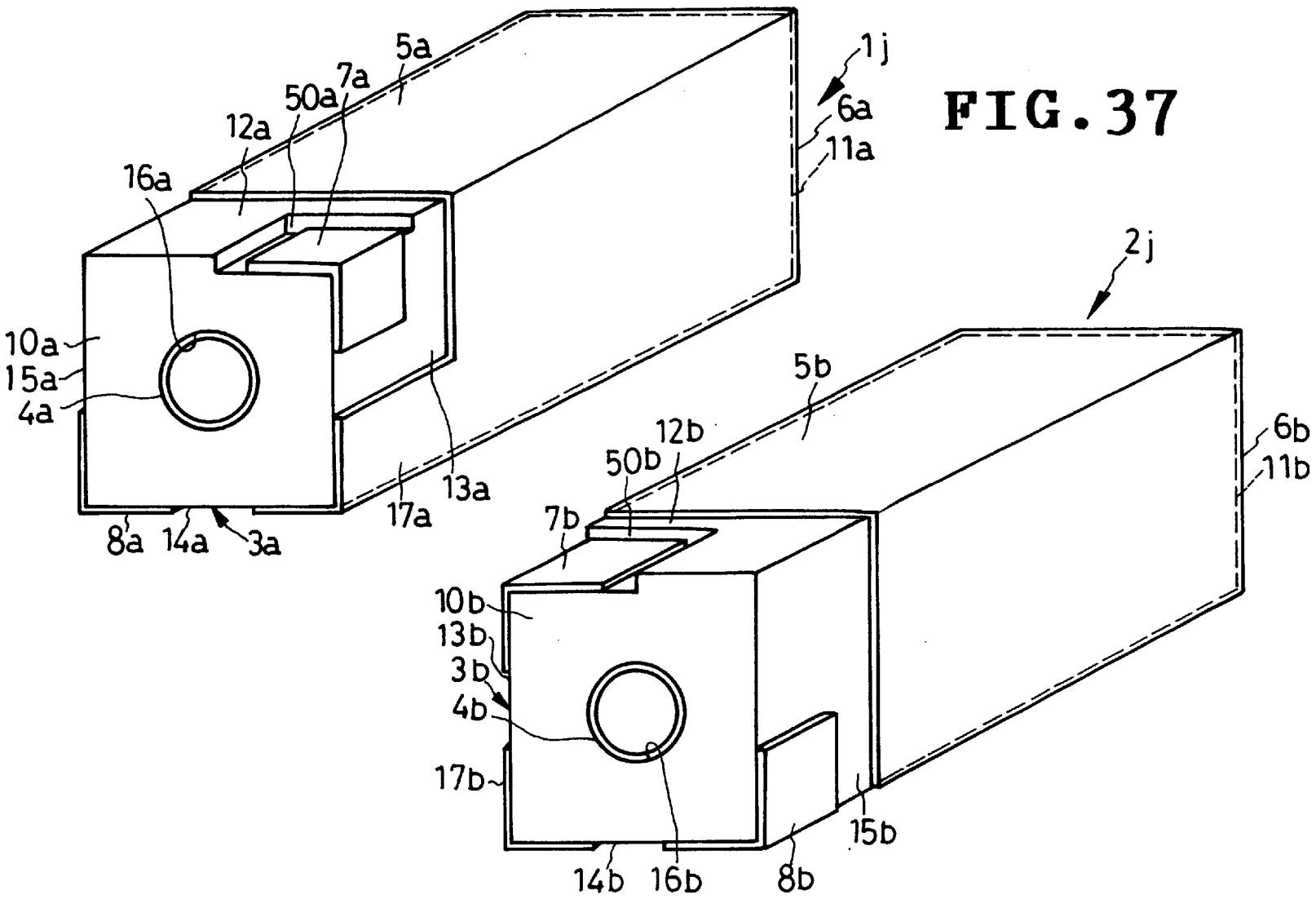
FIG. 37 is a exploded perspective view of a further preferred form of dielectric filter according to this invention.

Embodiment of FIG. 37

The pair of resonators 1*j* and 2*j* shown in FIG. 37 are modifications of the resonators 1 and 2 of the FIG. 1–13 filter. The following description of the resonators 1*j* and 2*j* will be best understood from a comparison of FIGS. 4 and 37.

The differences of the FIG. 37 resonators 1*j* and 2*j* from the FIG. 4 resonators 1 and 2 are:

1. The inner conductor extensions 9*a* and 9*b* of the FIG. 4 resonators are absent from the FIG. 37 resonators.

2. The outer conductor second extensions 18*a* and 18*b* of the FIG. 4 resonators are also absent from the FIG. 37 resonators.

3. The FIG. 37 resonators have depressions 50*a* and 50*b* formed in the dielectric body first side surfaces 12*a* and 12*b*, in which depressions there are received parts of the resonator coupling conductors 7*a* and 7*b*.

The partial placement of the resonator coupling conductors 7*a* and 7*b* In the dielectric body depressions 50*a* and 50*b* serve to make greater the capacitances between these conductors 7*a* and 7*b* and the inner conductors 4*a* and 4*b*.

There is another advantage arising from the partial placement of the resonator coupling conductors 7*a* and 7*b* in the dielectric body depressions 50*a* and 50*b*. The top surfaces of the conductors 7*a* and 7*b* can be made lower than those of the outer conductors 5*a* and 5*b*, or even those of the dielectric bodies 3*a* and 3*b*. In this manner, when an electromagnetic shield is placed upon the outer conductors 5*a* and 5*b*, the resonator coupling conductors 7*a* and 7*b* are prevented from contacting the shield.

Figure 38:
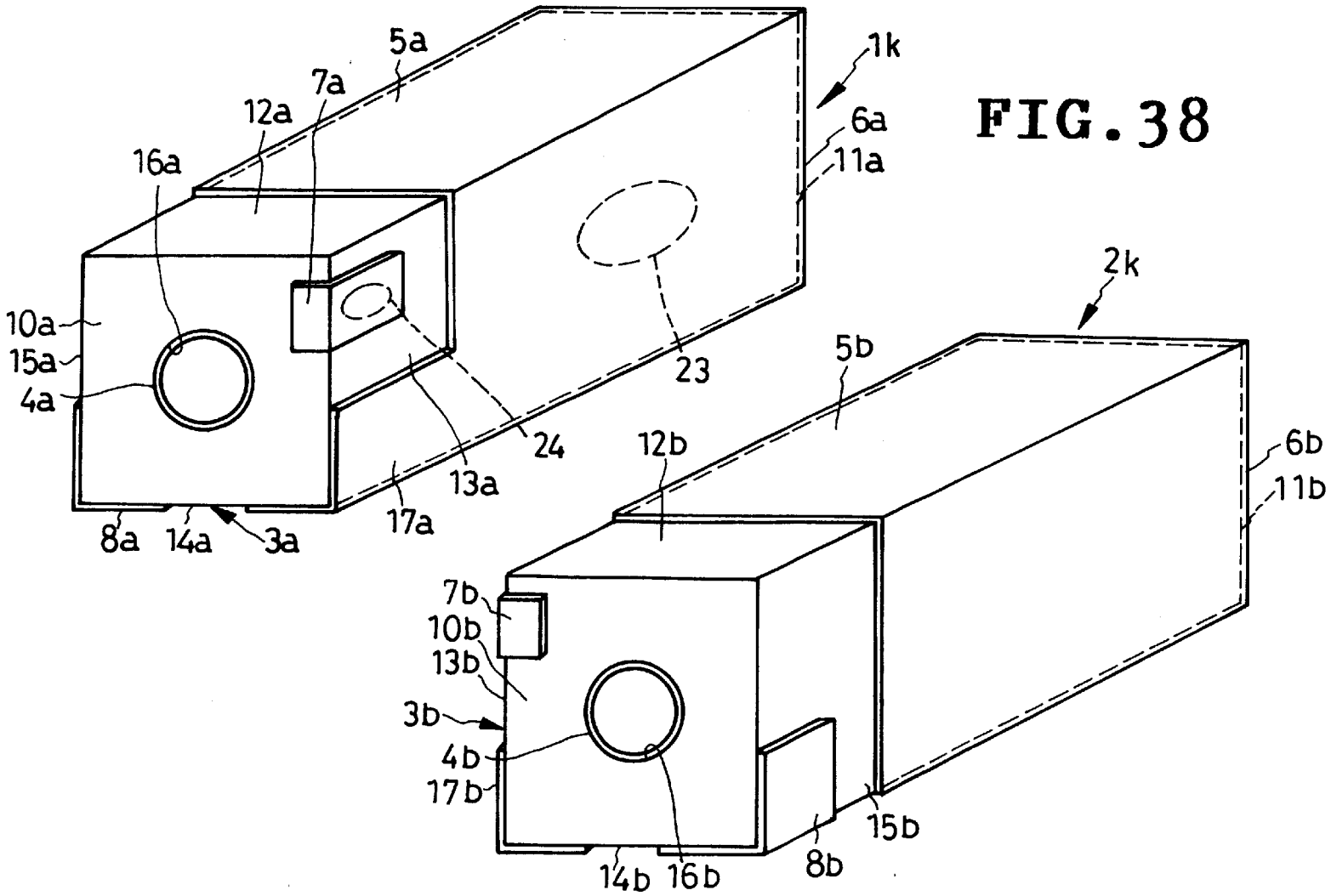
FIG. 38 is an exploded perspective view of a further preferred form of dielectric filter according to this invention.

Embodiment of FIG. 38

The pair of resonators 1*k* and 2*k* of FIG. 38 will also be best understood from a comparison of the first disclosed resonators 1 and 2 as pictured in FIG. 4. The differences of the FIG. 38 resonators 1*k* and 2*k* from the FIG. 4 resonators 1 and 2 are:

1. The inner conductor extensions 9*a* and 9*b* of the FIG. 4 resonators 1 and 2 are absent from the FIG. 38 resonators 1*k* and 2*k*.

2. The outer conductor second extensions 18*a* and 18*b* of the FIG. 4 resonators 1 and 2 are also absent from the FIG. 38 resonators 1*k* and 2*k*.

3. The FIG. 38 resonators 1*k* and 2*k* have resonator coupling conductor 7*a* and 7*b* are disposed in locations different from those of the FIG. 4 resonators 1 and 2.

The resonator coupling conductors 7*a* and 7*b* overlie the dielectric body second side surface 13*a* and 13*a* and first end surface 10*a* and 10*b* in the FIG. 38 resonators 1*k* and 2*k*, instead of on the dielectric body first and second side surfaces as in the FIG. 4 resonators. The absence of the resonator coupling conductors 7*a* and 7*b* from the dielectric body first side surfaces 12*a* and 12*b* serve to prevent their contact with the electromagnetic shield placed on the outer conductors 5*a* and 5*b*.

Figure 39:
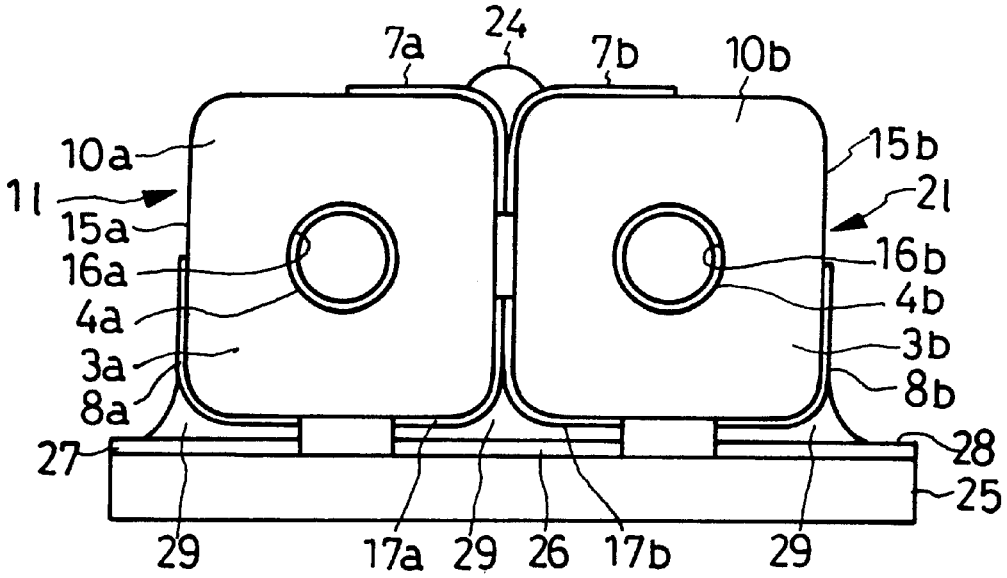
FIG. 39 is an end elevation of a further preferred form of dielectric filter according to this invention.

Embodiment of FIG. 39

The pair of resonators 1*l* and 2*l* shown in FIG. 39 differ from the resonators 1 and 2 of the FIGS. 1–13 filter in:

1. The absence of the inner conductor extensions 9*a* and 9*b*,

2. The absence of the outer conductor second extensions 18*a* and 18*b*.

3. The shape of the dielectric bodies 3*a* and 3*b*.

The shape of the dielectric bodies 3*a* and 3*b* of the FIG. 39 filter differ from that of the FIGS. 1–13 dielectric bodies in that all the longitudinal edges of the FIG. 39 bodies 3*a* and 3*b* are rounded with a predetermined radius The resonator coupling conductors 7*a* and 7*b*, terminal conductors 8*a* and 8*b*, and outer conductor extensions 17*a* and 17*b* are all formed on the two neighboring side surfaces of each dielectric body across the rounded edge therebetween.

The rounded longitudinal edges of the dielectric bodies 3*a* and 3*b* can be utilized advantageously in coupling together the two resonators 1*l* and 2*l* and mounting them on the circuit board 25 as in FIG. 39. Since the rounded edges provide a gap therebetween when the resonators 1*l* and 2*l* are placed side by side, an electroconductive bonding agent such as solder can be filled in this gap, as indicated at 24, for coupling them together. In mounting the resonators on the circuit board 25, the bonding agent can be filled at 29 in the space created by the two contiguous rounded edges between the outer conductor extensions 17*a* and 17*b* and the grounding conductor 26 on the circuit board 25. The terminal conductors 8*a* and 8*b* can likewise be joined at 29 to the terminal conductors 27 and 28 on the circuit board 25. Not only can the resonators 1*l* and 2*l* be positively coupled to each other and to the circuit board 25, but also it is visually observable whether they are or not.

The edges of the dielectric bodies may therefore be rounded with a any radius that is considered optimum for firm coupling of the resonators to each other and to the circuit board. It is even possible to form the dielectric bodies into cylindrical shape.

Figure 40:
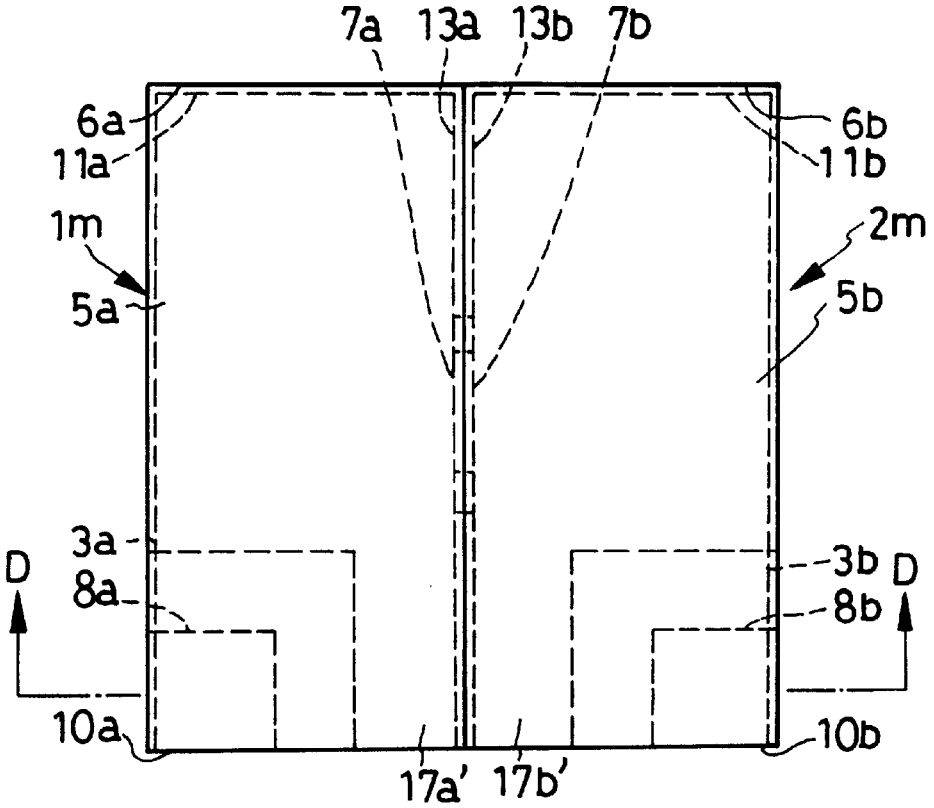
FIG. 40 is a top plan of a further preferred form of dielectric filter according to this invention.
Figure 41:
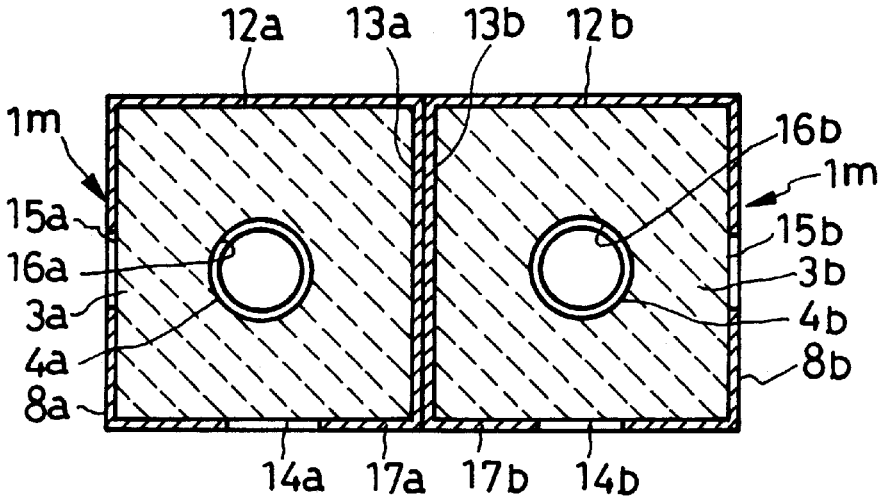
FIG. 41 is a section through the FIG. 40 filter, taken along the line D—D in FIG. 40.
Figure 42:
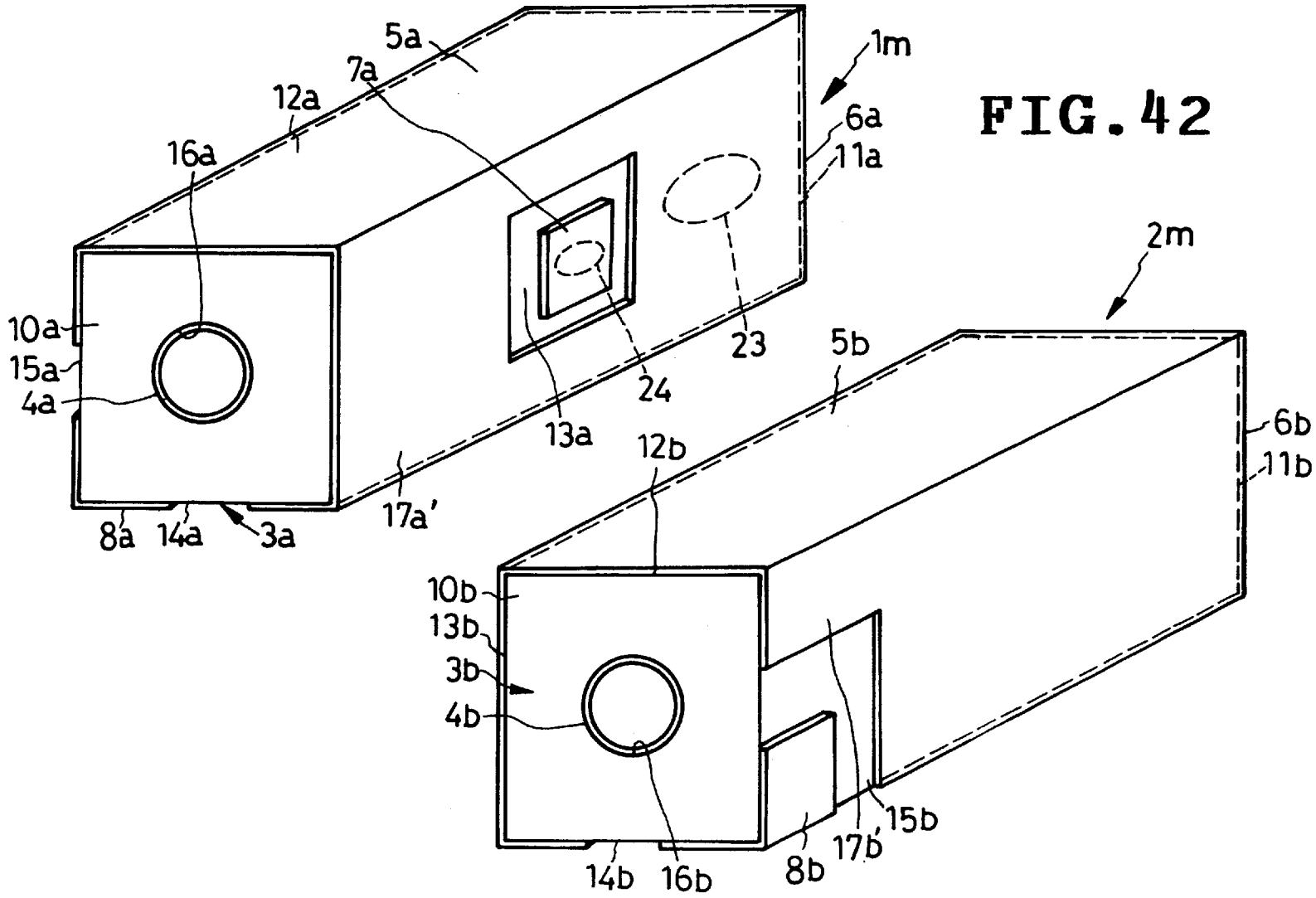
FIG. 42 is an exploded perspective view of the FIG. 40 filter.

Embodiment of FIGS. 40–42

The pair of resonators 1*m* and 2*m* shown in FIGS. 40–42 differ from the resonators 1 and 2 of the FIGS. 1–13 filter in:

1. The position of the resonator coupling conductors 7*a* and 7*b*.

2. The absence of the inner conductor extensions.

3. The absence of the outer conductor second extensions 18*a* and 18*b*.

4. The shape and size of the remaining outer conductor extensions 17*a*' and 17*b*'.

The resonator coupling conductors 7*a* and 7*b* of the FIGS. 40–42 resonators 1*m* and 2*m* are disposed centrally of the second side surfaces 13*a* and 13*b* of the dielectric bodies 3*a* and 3*b*. That part of the outer conductors 5*a* and 5*b* which overlie the dielectric body second side surfaces 13*a* and 13*a* have windows created therein for loosely receiving the resonator coupling conductors 7*a* and 7*b*.

The remaining outer conductor extensions 17*a*' and 17*b*' are much larger in size than the outer conductor first extensions 17*a* and 17*b* of the FIGS. 4 resonators 1 and 2. The extensions 17*a*' and 17*b*' cover all of the dielectric body first 12*a* and 12*b* and second 13*a* and 13*a* side surfaces and parts of the dielectric body third 14*a* and 14*b* and fourth 5*a* and 15*b* side surfaces. The terminal conductors 8*a* and 8*b* are the same in shape, size and position with those of the FIG. 4 resonators 1 and 2.

Thus the outer conductor extensions 17*a*' and 17*b*' contribute toward greater isolation of the terminal conductors 8*a* and 8*b* from each other and also provide the capacitances $Ct_1$' and $Ct_2$', FIG. 32, for the wavelength shortening effect. The resonator coupling conductors 7*a* and 7*b* of this embodiment also provide the capacitances $C_2$ and $C_3$ of both FIGS. 12 and 32 circuit.

Figure 43:
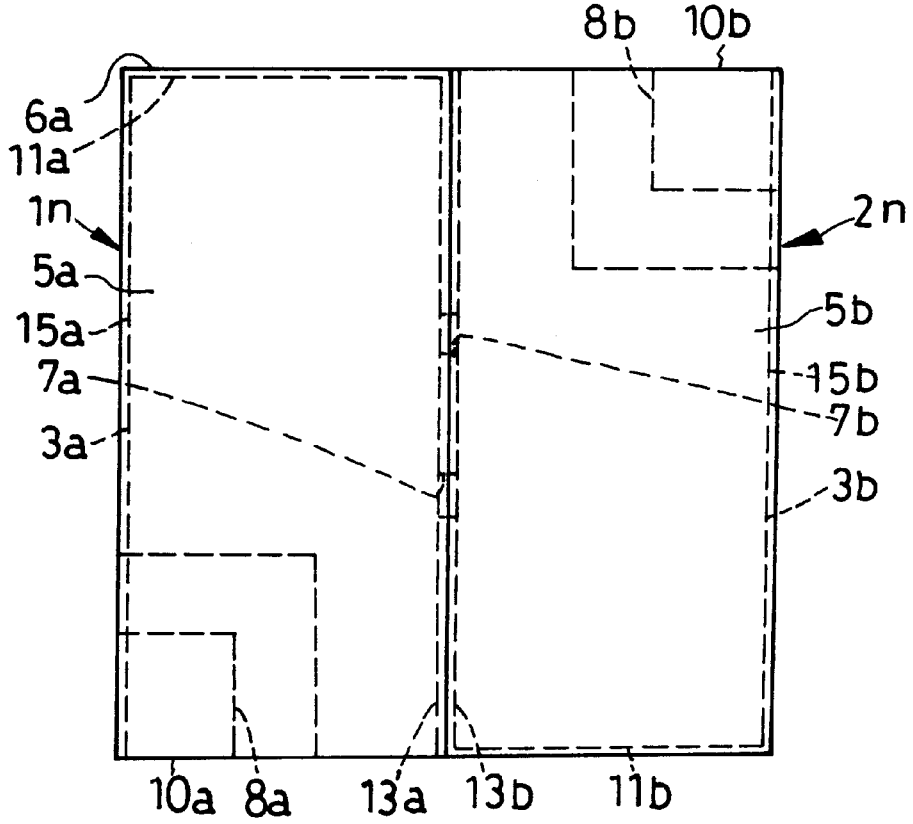
FIG. 43 is a top plan of a still further preferred form of dielectric filter according to this invention.
Figure 44:
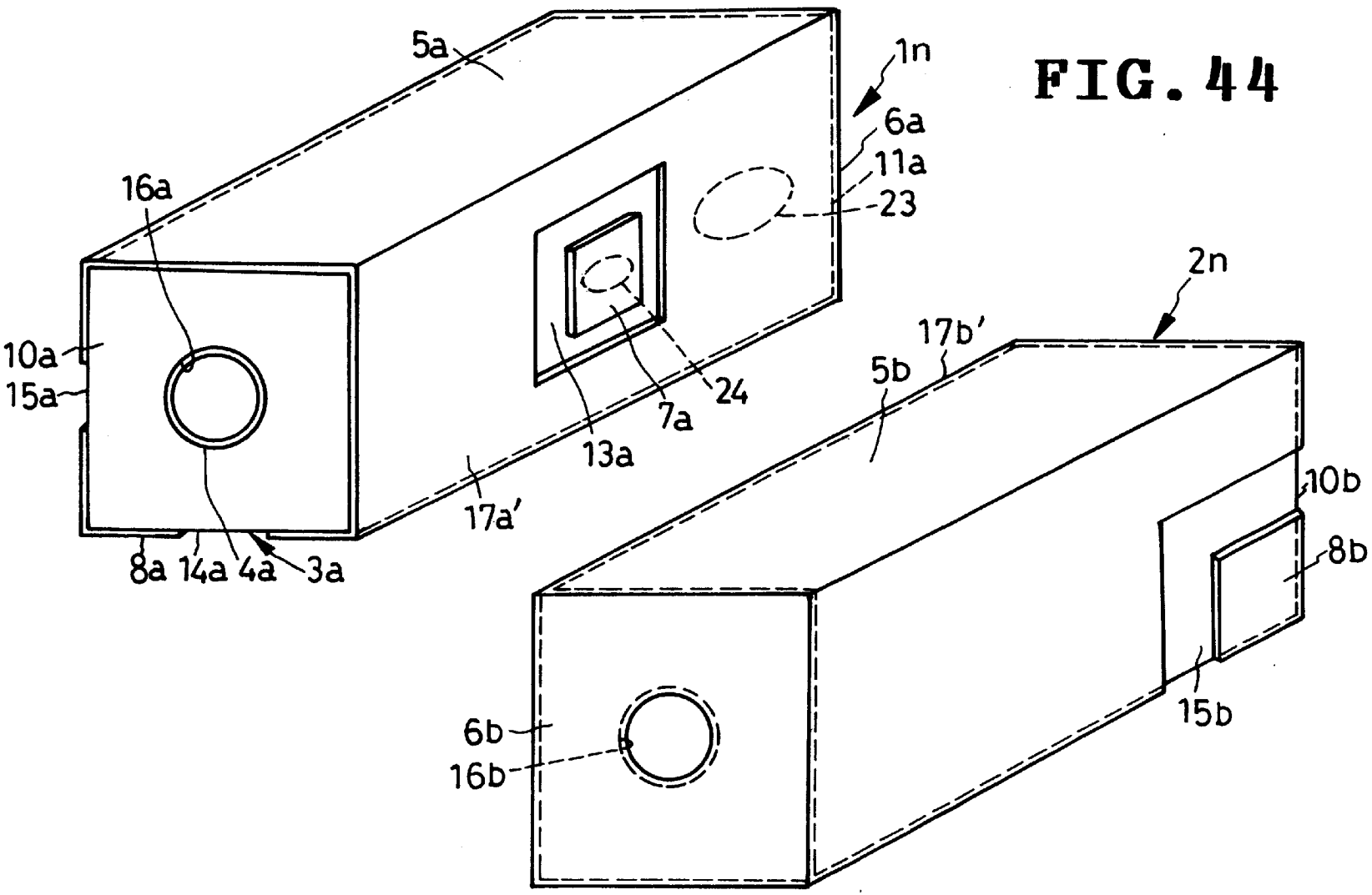
FIG. 44 is an exploded perspective view of the FIG. 43 filter.

Embodiment of FIGS. 43 and 44

The pair of dielectric resonators 1*n* and 2*n* of the FIGS. 43 and 44 filter are similar in construction to the resonators 1*m* and 2*m* of the FIGS. 40–42 filter. The only difference between these filters is that the resonator 2*n* of the FIGS. 43 and 44 filter is opposite in orientation to the corresponding resonator 2*m* of the FIGS. 40–42 filter.

With the resonators 1*n* and 2*n* so oriented in opposite directions, the terminal conductors 8*a* and 8*b* are spaced a greater distance from each other than when the resonators are oriented as in FIGS. 40–42. This positional advantage coacts with the outer conductor extensions 17*a* ' and 17*b*', as well as with the outer conductors 5*a* and 5*b*, to afford still greater isolation between the terminal conductors 8*a* and 8*b*.

Possible Modifications

Notwithstanding the foregoing detailed disclosure it is not desired that the present invention be limited by the exact showing of the draw ings or the description thereof. A variety of modifications and alterations are considered possible in the practice of this invention in order to conform to design preferences or to the requirements of each specific application. The following is but a few of such possible modifications:

1. Not only two or three dielectric resonators, as disclosed herein, but four or more could be juxtaposed for constituting wave filters in accordance with the invention.

2. The larger diameter portions 33*a* and 33*b* of the resonance holes of the FIGS. 21–23 dielectric resonators 1*e* and 2*e* could be square or otherwise polygonal in cross sectional shape.

3. The larger diameter portions 33*a* and 33*b* of the resonance holes of the FIGS. 21–23 resonators 1*e* and 2*e* could be made so shallow (e.g., somewhat more than the thickness of the inner conductors 4*a* and 4*b*) that the inner conductor portions 35*a* and 35*b* lining the larger diameter portions would perform the same functions as the inner conductor extensions 9*a* and 9*b* of the FIGS. 1–13 filter.

What is claimed is:

1. A dielectric wave filter having at least two dielectric resonators in juxtaposition, each dielectric resonator comprising:

(a) a dielectric body having a pair of opposite end surfaces, a plurality of side surfaces between the pair of end surfaces, and a resonance hole extending between the pair of end surfaces one of the side surfaces of each dielectric body confronting the other dielectric body;

(b) an inner conductor covering an inner surface of the dielectric body;

(c) an outer conductor covering parts of the side surfaces of the dielectric body, which parts are contiguous to one of the end surfaces of the dielectric body, the outer conductors on both dielectric bodies being joined to each other both mechanically and electrically;

(d) a shorting conductor covering said one end surface of the dielectric body and electrically interconnecting the inner and the outer conductors;

(e) a resonator coupling conductor covering parts of at least that side surface of each dielectric body which confronts the other dielectric body, the resonator coupling conductors on both dielectric bodies being joined to each other both mechanically and electrically;

(f) a terminal conductor covering parts of the surfaces of each dielectric body and disposed adjacent the other of the end surfaces thereof, the terminal conductors on both dielectric bodies being disposed at least on those side surfaces of the dielectric bodies which face away from each other; and (g) an outer conductor extension extending from the outer conductor on each dielectric body toward said other end surface thereof and being formed to include a constricted neck portion and a head portion, the outer conductor extensions on both dielectric bodies being disposed at least on those side surfaces of the dielectric bodies which confront each other, thereby intervening between the terminal conductors on both dielectric bodies for electrically isolating the terminal conductors from each other.

2. A dielectric wave filter having at least two dielectric resonators in juxtaposition, each dielectric resonator comprising:

(a) a dielectric body having a pair of opposite end surfaces, a plurality of side surfaces between the pair of end surfaces, and a resonance hole extending between the pair of end surfaces, one of the side surfaces of each dielectric body confronting the other dielectric body;

(b) an inner conductor covering an inner surface of the dielectric body;

(c) an outer conductor covering parts of the side surfaces of the dielectric body, which parts are contiguous to one of the end surfaces of the dielectric body, the outer conductors on both dielectric bodies being joined to each other both mechanically and electrically;

(d) a shorting conductor covering said one end surface of the dielectric body and electrically interconnecting the inner and the outer conductors;

(e) a resonator coupling conductor covering parts of at least that side surface of each dielectric body which confronts the other dielectric body, the resonator coupling conductors on both dielectric bodies being joined to each other both mechanically and electrically;

(f) a terminal conductor covering parts of the surfaces of each dielectric body and disposed adjacent the other of the end surfaces thereof, the terminal conductors on both dielectric bodies being disposed at least on those side surfaces of the dielectric bodies which face away from each other;

(g) an outer conductor extension extending from the outer conductor on each dielectric body toward said other end surface thereof and being formed to include a constricted neck portion and a head portion, the outer conductor extensions on both dielectric bodies being disposed at least on those side surfaces of the dielectric bodies which confront each other, thereby intervening between the terminal conductors on both dielectric bodies for electrically isolating the terminal conductors from each other; and (h) the side surfaces of each dielectric body having a first side surface, a second side surface contiguous to the first side surface and confronting the other dielectric body, a third side surface contiguous to the second side surface, and a fourth side surface contiguous to both first and third side surfaces and facing away from the other dielectric body, the resonator coupling conductor covering parts of the first and the second side surface of each dielectric body, and the resonator coupling conductor being partly received in a depression formed in the first side surface.

3. A dielectric wave filter having at least two dielectric resonators in juxtaposition, each dielectric resonator comprising:

(a) a dielectric body having a pair of opposite end surfaces, a plurality of side surfaces between the pair of end surfaces, and a resonance hole extending between the pair of end surfaces, one of the side surfaces of each dielectric body confronting the other dielectric body;

(b) an inner conductor covering an inner surface of the dielectric body;

(c) an outer conductor covering parts of the side surfaces of the dielectric body, which parts are contiguous to one of the end surfaces of the dielectric body, the outer conductors on both dielectric bodies being joined to each other both mechanically and electrically;

(d) a shorting conductor covering said one end surface of the dielectric body and electrically interconnecting the inner and the outer conductors;

(e) a resonator coupling conductor covering parts of at least that side surface of each dielectric body which confronts the other dielectric body, and additionally covering part of said other end surface of each dielectric body, the resonator coupling conductors on both dielectric bodies being joined to each other both mechanically and electrically;

(f) a terminal conductor covering parts of the surfaces of each dielectric body and disposed adjacent the other of the end surfaces thereof, the terminal conductors on both dielectric bodies being disposed at least on those side surfaces of the dielectric bodies which face away from each other; and (g) an outer conductor extension extending from the outer conductor on each dielectric body toward said other end surface thereof and being formed to include a constricted neck portion and a head portion, the outer conductor extensions on both dielectric bodies being disposed at least on those side surfaces of the dielectric bodies which confront each other, thereby intervening between the terminal conductors on both dielectric bodies for electrically isolating the terminal conductors from each other.

4. A dielectric wave filter having at least two dielectric resonators in juxtaposition, each dielectric resonator comprising:

(a) a dielectric body having a pair of opposite end surfaces, a plurality of side surfaces between the pair of end surfaces, and a resonance hole extending between the pair of end surfaces, one of the side surfaces of each dielectric body confronting the other dielectric body, each dielectric body having rounded corners between the side surfaces;

(b) an inner conductor covering an inner surface of the dielectric body;

(c) an outer conductor covenng parts of the side surfaces of the dielectric body, which parts are contiguous to one of the end surfaces of the dielectric body, the outer conductors on both dielectric bodies being joined to each other both mechanically and electrically;

(d) a shorting conductor covering said one end surface of the dielectric body and electrically interconnecting the inner and the outer conductors;

(e) a resonator coupling conductor covering parts of at least that side surface of each dielectric body which confronts the other dielectric body, the resonator coupling conductors on both dielectric bodies being joined to each other both mechanically and electrically;

(f) a terminal conductor covering parts of the surfaces of each dielectric body and disposed adjacent the other of the end surfaces thereof, the terminal conductors on both dielectric bodies being disposed at least on those side surfaces of the dielectric bodies which face away from each other; and (g) an outer conductor extension extending from the outer conductor on each dielectric body toward said other end surface thereof and being formed to include a constricted neck portion and a head portion, the outer conductor extensions on both dielectric bodies being disposed at least on those side surfaces of the dielectric bodies which confront each other, thereby intervening between the terminal conductors on both dielectric bodies for electrically isolating the terminal conductors from each other.

5. A dielectric wave filter having at least two dielectric resonators in juxtaposition, each dielectric resonator comprising:

(a) a dielectric body having a pair of opposite end surfaces, a first side surface, a second side surface contiguous to the first side surface and confronting the other dielectric body, a third side surface contiguous to the second side surface, a fourth side surface contiguous to both first and third side surfaces and facing away from the other dielectric body, and a resonance hole extending between the pair of end surfaces;

(b) an inner conductor covering an inner surface of the dielectric body;

(c) an outer conductor covering parts of the side surfaces of the dielectric body, which parts are contiguous to one of the end surfaces of the dielectric body, the outer conductors on both dielectric bodies being joined to each other both mechanically and electrically;

(d) a shorting conductor covering said one end surface of the dielectric body and electrically interconnecting the inner and the outer conductors;

(e) a resonator coupling conductor covering parts of the first and second side surfaces ofeach dielectric body which confronts the other dielectric body, the resonator coupling conductors on both dielectric bodies being joined to each other both mechanically and electrically;

(f) a terminal conductor covering parts of the third and fourth side surfaces of each dielectric body and disposed adjacent the other ofthe end surfaces thereof, the terminal conductors on both dielectric bodies being disposed at least on those side surfaces of the dielectric bodies which face away from each other;

(g) a first outer conductor extension extending from the outer conductor on each dielectric body toward said other end surface thereof, the first outer conductor extensions on both dielectric bodies being disposed on parts of the second side surfaces of the dielectric bodies which confront each other, and parts of the third side surfaces thereof; and (h) a second outer conductor extension extending from the outer conductor on each dielectric body toward said other end surface thereof, the second outer conductor extension on each dielectric body being disposed on parts of the first and fourth side surfaces thereof.

6. A dielectric wave filter comprising:

(a) a pair of first dielectric resonators, each first dielectric resonator comprising:

(i) a first dielectric body having a pair of opposite end surfaces, a first side surface, a second side surface contiguous to the first side surface, a third side surface contiguous to the second side surface, a fourth side surface contiguous to both first and third side surfaces, and a resonance hole extending between the pair of end surfaces;

(ii) an inner conductor covering an inner surface of the first dielectric body;

(iii) an outer conductor covering parts of the side surfaces of the first dielectric body, which parts are contiguous to one of the end surfaces of the first dielectric body;

(iv) a shorting conductor covering said one end surface of the first dielectric body and electrically interconnecting the inner and the outer conductors;

(v) a resonator coupling conductor covering parts of the first and second side surfaces of the first dielectric body;

(vi) a terminal conductor covering parts of the third and fourth side surfaces of the first dielectric body and disposed adjacent the other of the end surfaces thereof;

(vii) a first outer conductor extension extending from the outer conductor toward said other end surface of the first dielectric body, the first outer conductor extension being disposed on parts of the second and third side surfaces of the first dielectric body; and (viii) a second outer conductor extension extending from the outer conductor toward said other end surface of the first dielectric body, the second outer conductor extension being disposed on parts of the first and fourth side surfaces of the first dielectric body; and (b) a second dielectric resonator interposed between the pair of first dielectric resonators, the second dielectric resonator comprising:

(i) a second dielectric body having a pair of opposite end surfaces, a first side surface, a second side surface contiguous to the first side surface of the second dielectric body and confronting one of the pair of first dielectric resonators, a third side surface contiguous to the second side surface of the second dielectric body, a fourth side surface contiguous to both first and third side surfaces of the second dielectric body and confronting the other of the pair of first dielectric resonators, and a resonance hole extending between the pair of end surfaces;

(ii) an inner conductor covering an inner surface of the second dielectric body;

(iii) an outer conductor covering parts of the side surfaces of the second dielectric body, which parts are contiguous to one of the end surfaces of the second dielectric body, the outer conductors of the second dielectric body being joined to the outer conductors of the pair of first dielectric resonators both mechanically and electrically;

(iv) a shorting conductor covering said one end surface of the second dielectric body and electrically interconnecting the inner and the outer conductors of the second dielectric resonator;

(v) a pair of resonator coupling conductors covering parts of at least the second and fourth side surfaces of the second dielectric body, the pair of resonator coupling conductors being joined to the resonator coupling conductors of the first dielectric resonators both mechanically and electrically;

(vi) a first outer conductor extension extending from the outer conductor toward said other end surface of the second dielectric body, the first outer conductor extensions on the second dielectric body being disposed on parts of the second and third side surfaces of the second dielectric body; and (vii) a second outer conductor extension extending from the outer conductor toward said other end surface of the second dielectric body, the second outer conductor extension on the second dielectric body being disposed on parts ofthe third and fourth side surfaces of the second dielectric body;

(c) whereby the outer conductor extensions of both first and second dielectric resonators intervene between the terminal conductors of the second dielectric resonators for electrically isolating the terminal conductors from each other.

* * * * *

UNITED STATES PATENT AND TRADEMARK OFFICE

CERTIFICATE OF CORRECTION

PATENT NO. : 6,275,125 B1
DATED : August 14, 2001
INVENTOR(S) : Kenji Takei et al.

It is certified that error appears in the above-identified patent and that said Letters Patent is hereby corrected as shown below:

Title page,
Item [75], Inventors, please delete “Takasaki” and insert therefore -- Takasaki-shi --; (all occurrences)

Column 1,
Line 23, after “nators” insert therefore -- . --;

Column 2,
Line 17, please delete “Is” and insert therefore -- is --;

Column 5,
Line 3, please delete second occurrence of “3a” and insert therefore -- 3b --;
Line 13, please delete “13a” and insert therefore -- 13b --;
Line 14, after “15b” insert therefore -- . --;
Line 15, please delete second occurrence of “3a” and insert therefore -- 3b --;
Line 16, please delete “i 1b” and insert therefore -- 11b --;
Line 23, please delete second occurrence of “3a” and insert therefore -- 3b --;
Line 29, after “surfaces” insert therefore -- . --;
Line 33, please delete second occurrence of “3a” and insert therefore -- 3b --;
Line 39, please delete “13a” and insert therefore -- 13b --;
Line 44, after “13b” insert therefore -- . --;
Line 62, please delete “13a” and insert therefore -- 13b --;

Column 6,
Line 5, please delete second occurrence of “13a” and insert therefore -- 13b --;
Line 13, please delete “surs faces” and insert therefore -- surfaces --;
Line 22, please delete “1b” and insert therefore -- 10b --;
Line 25, please delete “8*” and insert therefore -- 8a --;
Line 28, after “surfaces” insert therefore --. --;
Line 37, please delete “3a” and insert therefore -- 3b --;

UNITED STATES PATENT AND TRADEMARK OFFICE

CERTIFICATE OF CORRECTION

PATENT NO. : 6,275,125 B1
DATED : August 14, 2001
INVENTOR(S) : Kenji Takei et al.

It is certified that error appears in the above-identified patent and that said Letters Patent is hereby corrected as shown below:

Column 6, cont'd
Lines 57 and 61, please delete second occurrence of "13a" and insert therefore -- 13b --;
Line 63, please delete "sand" and insert therefore -- and --;
Line 67, please delete "existing tending" and insert therefore -- extending --;

Column 7,
Line 8, please delete "2 1a" and insert therefore -- 21a --;
Line 8, please delete "2 1b" and insert therefore -- 21b --;
Line 31, please delete second occurrence of "3a" and insert therefore -- 3b --;
Line 34, please delete "91" and insert therefore -- 9b --;

Column 8,
Line 15, please delete second occurrence of "3a" and insert therfore -- 3b --;
Line 22, please delete "9b L" and insert therefore -- 9b. --;

Column 9,
Line 2, please delete "extent" and insert therefore -- extents. --;
Line 6, after "removed" insert therefore -- . --;
Line 13, after "arrows" insert therefore -- . --;
Line 13, please delete "fi" and insert therefore -- f0 --;
Line 16, please delete "54b" and insert therefore -- 5b--;
Line 64, please delete "1b" and insert therefore -- 1d --;

Column 10,
Line 2, please delete "1b" and insert therefore -- 1d --;
Line 55, please delete "Is";

Column 11,
Line 16, please delete "conduce tor" and insert therefore -- conductor --;
Line 18, after "effect" insert therefore -- . --;
Line 34, please delete "2c" and insert therefore -- 2e --;
Line 35, after "one" insert therefore -- . --;
Line 44, please delete second occurrence of "33a" and insert therefore -- 33b --;

UNITED STATES PATENT AND TRADEMARK OFFICE

CERTIFICATE OF CORRECTION

PATENT NO. : 6,275,125 B1
DATED : August 14, 2001
INVENTOR(S) : Kenji Takei et al.

It is certified that error appears in the above-identified patent and that said Letters Patent is hereby corrected as shown below:

Column 11, cont'd
Line 45, after "5a" insert therefore -- 5b, -- ;
Line 52, please delete "3a i" and insert therefore -- 3b, -- ;
Line 58, after "16b" insert therefore -- . --;

Column 12,
Line 21, please delete "34" and insert therefore -- 3b, --;
Line 22, after "example" insert therefore -- . --;

Column 13,
Lines 12 and 17, please delete second occurrence of "13a" and insert therefore -- 13b --;
Line 18, please delete "4 1a" and insert therefore -- 41a --;
Line 18, please delete "41b" and insert therefore -- 41b --;
Line 19, please delete "42h" and insert therefore -- 42b --;
Line 38, please delete "4 1a" and insert therefore -- 41a --;
Line 39, please delete "4 1b" and insert therefore -- 41b --;
Line 52, after "17b" insert therefore -- . --;
Line 65, please delete "4 1a" and insert therefore -- 41a --;
Line 66, please delet e"4 1b" and insert therefore -- 41b --;

Column 14,
Line 6, please delete second occurrence of "43a" and insert therefore -- 43b --;
Lines 8 and 11, please delete second occurrence of "3a" and insert therefore -- 3b --;
Line 12, please delete second occurrence of "43a" and insert therefore -- 43b --;
Line 34, please delete "4 1a," and insert therefore -- 41a, --;
Line 47, please delete "5a" and insert therefore -- 5a, --;

Column 15,
Line 15, please delete "is" and insert therefore -- li --;
Line 37, please delete "In" and insert therefore -- in --;
Line 67, please delete second occurrence of "13a" and insert therefore -- 13b --;

UNITED STATES PATENT AND TRADEMARK OFFICE

CERTIFICATE OF CORRECTION

PATENT NO. : 6,275,125 B1
DATED : August 14, 2001
INVENTOR(S) : Kenji Takei et al.

It is certified that error appears in the above-identified patent and that said Letters Patent is hereby corrected as shown below:

Column 16,
Line 65, please delete second occurrence of “13a” and insert therefore -- 13b --;

Column 17,
Line 5, please delete second occurrence of “13a” and insert therefore -- 13b --;
Line 6, please delete “5a” and insert therefore -- 15a --;
Line 36, please delete “draw ings” and insert therefore -- drawings --;

Column 20,
Line 1, please delete “covening” and insert therefore -- covering --;
Line 16, after “adjacent” insert therefore -- to --;
Line 54, please delete “ofeach” and insert therefore -- if each --;
Line 60, please delete “ofthe” and insert therefore -- of the --;

Column 22,
Line 41, please delete “ofthe” and insert therefore -- of the --.

Signed and Sealed this

Eighth Day of July, 2003

JAMES E. ROGAN
*Director of the United States Patent and Trademark Office*